US008558845B2

(12) United States Patent
Nakashin

(10) Patent No.: US 8,558,845 B2
(45) Date of Patent: Oct. 15, 2013

(54) DATA CONVERSION APPARATUS AND DATA CONVERSION METHOD

(75) Inventor: Yoshitaka Nakashin, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 13/040,655

(22) Filed: Mar. 4, 2011

(65) Prior Publication Data

US 2011/0221761 A1 Sep. 15, 2011

(30) Foreign Application Priority Data

Mar. 11, 2010 (JP) ..... 2010-054078

(51) Int. Cl.
*G09G 5/06* (2006.01)

(52) U.S. Cl.
USPC ..... 345/601

(58) Field of Classification Search
USPC ..... 345/600, 601, 602, 604, 591
See application file for complete search history.

(56) References Cited

U.S. PATENT DOCUMENTS 5,684,981 A * 11/1997 Jones ..... 345/566
7,164,397 B2 * 1/2007 Pettitt et al. ..... 345/63

FOREIGN PATENT DOCUMENTS

JP A 2001-036755 2/2001
JP B2 3755345 3/2006

* cited by examiner

*Primary Examiner* — Ke Xiao
*Assistant Examiner* — Wei-Wei Sun
(74) *Attorney, Agent, or Firm* — Oliff & Berridge, PLC

(57) ABSTRACT

A data conversion apparatus for converting converted data that belongs to an m-axis data space, includes: a data storage unit that stores correction data at respective lattice points of an m-dimensional lookup table; and a data conversion unit that reads the correction data at the lattice points positioned around the converted data from the first to N-th memories with reference to the m-dimensional lookup table, and converts the converted data, wherein the data storage unit assumes a virtual m-dimensional lookup table, which has an axis in which one virtual lattice point is included on the side of an end portion of the axis, and the data storage unit stores the data at the respective virtual lattice points and the correction data at the lattice points except for the virtual lattice points in the virtual m-dimensional lookup table in the first to N-th memories.

7 Claims, 29 Drawing Sheets z=0
| y \ x | 0 | 1 | 2 | 3 | 4 | 5 | 6 |
|---|---|---|---|---|---|---|---|
| 0 | D000 | D001 | D002 | D003 | D004 | D005 | D006 |
| 1 | D007 | D008 | D009 | D010 | D011 | D012 | D013 |
| 2 | D014 | D015 | D016 | D017 | D018 | D019 | D020 |
| 3 | D021 | D022 | D023 | D024 | D025 | D026 | D027 |
| 4 | D028 | D029 | D030 | D031 | D032 | D033 | D034 |
z=0
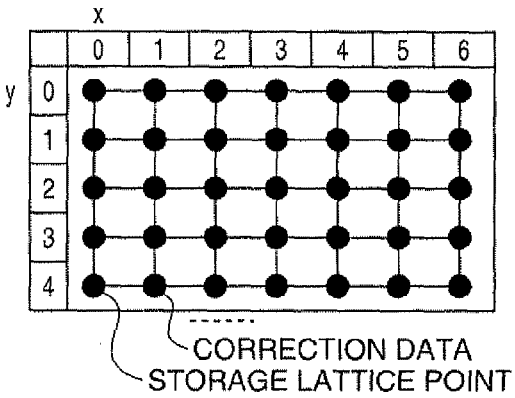
z=1
| y \ x | 0 | 1 | 2 | 3 | 4 | 5 | 6 |
|---|---|---|---|---|---|---|---|
| 0 | D035 | D036 | D037 | D038 | D039 | D040 | D041 |
| 1 | D042 | D043 | D044 | D045 | D046 | D047 | D048 |
| 2 | D049 | D050 | D051 | D052 | D053 | D054 | D055 |
| 3 | D056 | D057 | D058 | D059 | D060 | D061 | D062 |
| 4 | D063 | D064 | D065 | D066 | D067 | D068 | D069 |
z=1
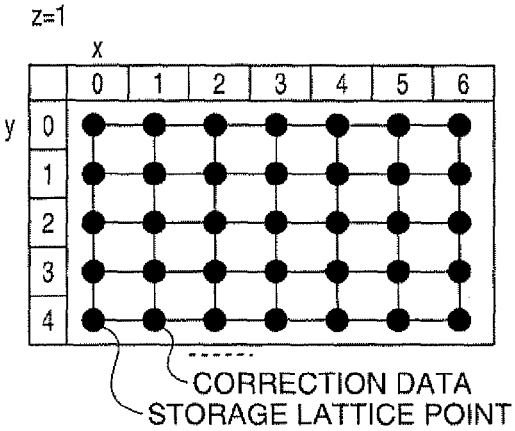
z=2
| y \ x | 0 | 1 | 2 | 3 | 4 | 5 | 6 |
|---|---|---|---|---|---|---|---|
| 0 | D070 | D071 | D072 | D073 | D074 | D075 | D076 |
| 1 | D077 | D078 | D079 | D080 | D081 | D082 | D083 |
| 2 | D084 | D085 | D086 | D087 | D088 | D089 | D090 |
| 3 | D091 | D092 | D093 | D094 | D095 | D096 | D097 |
| 4 | D098 | D099 | D100 | D101 | D102 | D103 | D104 |
z=2
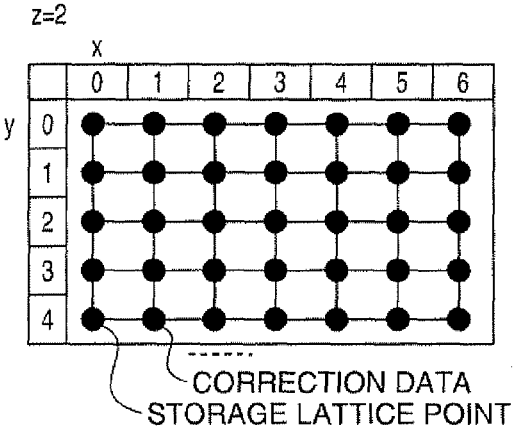
FIG. 7 z=3
| y \ x | 0 | 1 | 2 | 3 | 4 | 5 | 6 |
|---|---|---|---|---|---|---|---|
| 0 | D105 | D106 | D107 | D108 | D109 | D110 | D111 |
| 1 | D112 | D113 | D114 | D115 | D116 | D117 | D118 |
| 2 | D119 | D120 | D121 | D122 | D123 | D124 | D125 |
| 3 | D126 | D127 | D128 | D129 | D130 | D131 | D132 |
| 4 | D133 | D134 | D135 | D136 | D137 | D138 | D139 |
z=3
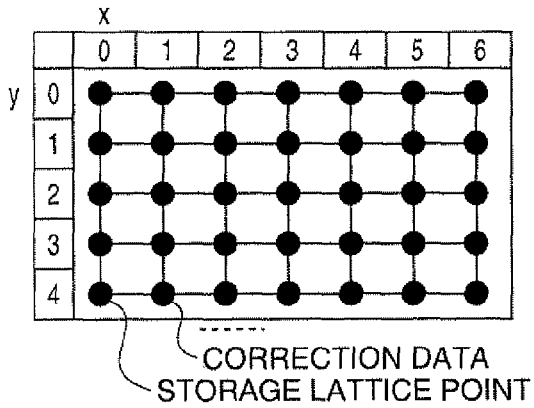
z=4
| y \ x | 0 | 1 | 2 | 3 | 4 | 5 | 6 |
|---|---|---|---|---|---|---|---|
| 0 | D140 | D141 | D142 | D143 | D144 | D145 | D146 |
| 1 | D147 | D148 | D149 | D150 | D151 | D152 | D153 |
| 2 | D154 | D155 | D156 | D157 | D158 | D159 | D160 |
| 3 | D161 | D162 | D163 | D164 | D165 | D166 | D167 |
| 4 | D168 | D169 | D170 | D171 | D172 | D173 | D174 |
z=4
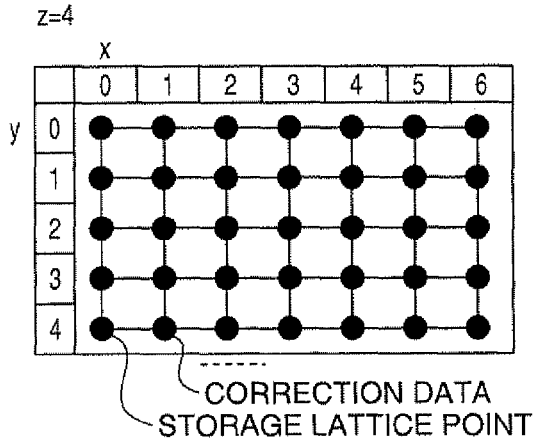
z=5
| y \ x | 0 | 1 | 2 | 3 | 4 | 5 | 6 |
|---|---|---|---|---|---|---|---|
| 0 | D175 | D176 | D177 | D178 | D179 | D180 | D181 |
| 1 | D182 | D183 | D184 | D185 | D186 | D187 | D188 |
| 2 | D189 | D190 | D191 | D192 | D193 | D194 | D195 |
| 3 | D196 | D197 | D198 | D199 | D200 | D201 | D202 |
| 4 | D203 | D204 | D205 | D206 | D207 | D208 | D209 |
z=5
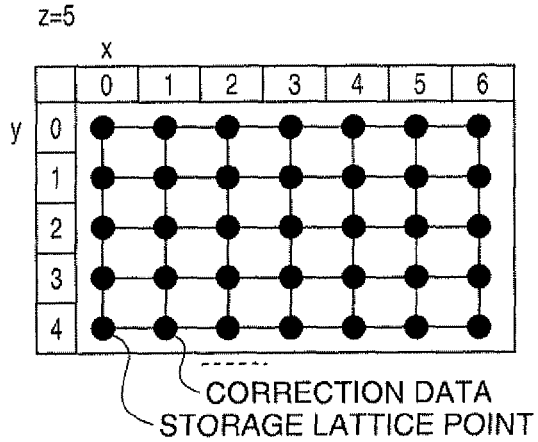
FIG. 8 z=6
| y \ x | 0 | 1 | 2 | 3 | 4 | 5 | 6 |
|---|---|---|---|---|---|---|---|
| 0 | D210 | D211 | D212 | D213 | D214 | D215 | D216 |
| 1 | D217 | D218 | D219 | D220 | D221 | D222 | D223 |
| 2 | D224 | D225 | D226 | D227 | D228 | D229 | D230 |
| 3 | D231 | D232 | D233 | D234 | D235 | D236 | D237 |
| 4 | D238 | D239 | D240 | D241 | D242 | D243 | D244 |
z=6
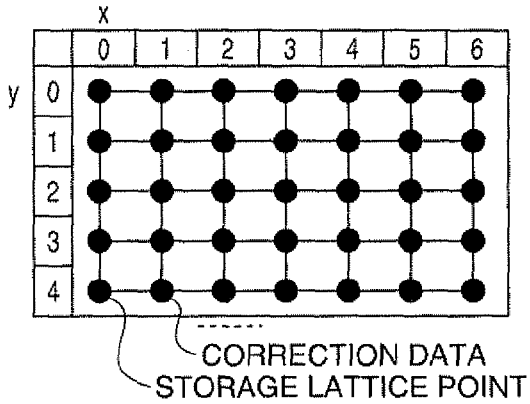
z=7
| y \ x | 0 | 1 | 2 | 3 | 4 | 5 | 6 |
|---|---|---|---|---|---|---|---|
| 0 | D245 | D246 | D247 | D248 | D249 | D250 | D251 |
| 1 | D252 | D253 | D254 | D255 | D256 | D257 | D258 |
| 2 | D259 | D260 | D261 | D262 | D263 | D264 | D265 |
| 3 | D266 | D267 | D268 | D269 | D270 | D271 | D272 |
| 4 | D273 | D274 | D275 | D276 | D277 | D278 | D279 |
z=7
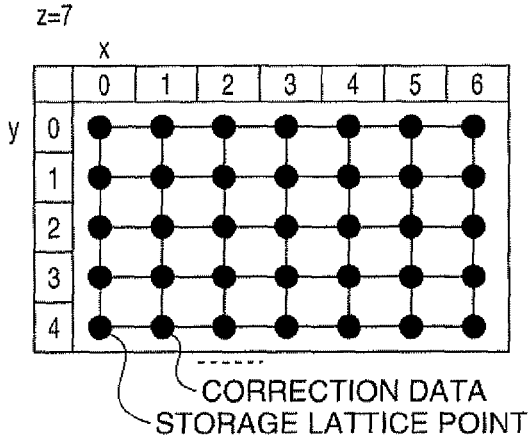
FIG. 9 z=0
| y \ x | 0 | 1 | 2 | 3 | 4 | 5 | 6 | 7 |
|---|---|---|---|---|---|---|---|---|
| 0 | D000 | D001 | D002 | D003 | D004 | D005 | D006 | pad |
| 1 | D007 | D008 | D009 | D010 | D011 | D012 | D013 | pad |
| 2 | D014 | D015 | D016 | D017 | D018 | D019 | D020 | pad |
| 3 | D021 | D022 | D023 | D024 | D025 | D026 | D027 | pad |
| 4 | D028 | D029 | D030 | D031 | D032 | D033 | D034 | pad |
| 5 | pad | pad | pad | pad | pad | pad | pad | pad |
z=0
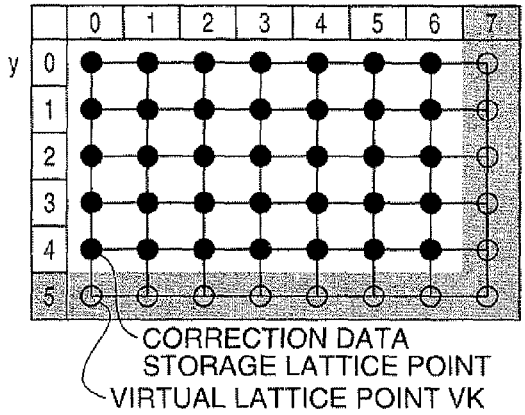
z=1
| y \ x | 0 | 1 | 2 | 3 | 4 | 5 | 6 | 7 |
|---|---|---|---|---|---|---|---|---|
| 0 | D035 | D036 | D037 | D038 | D039 | D040 | D041 | pad |
| 1 | D042 | D043 | D044 | D045 | D046 | D047 | D048 | pad |
| 2 | D049 | D050 | D051 | D052 | D053 | D054 | D055 | pad |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |
z=1
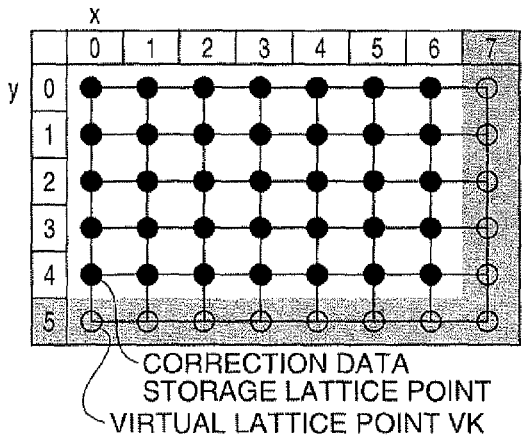
z=2
| y \ x | 0 | 1 | 2 | 3 | 4 | 5 | 6 | 7 |
|---|---|---|---|---|---|---|---|---|
| 0 | D070 | D071 | D072 | D073 | D074 | D075 | D076 | pad |
| 1 | D077 | D078 | D079 | D080 | D081 | D082 | D083 | pad |
| 2 | D084 | D085 | D086 | D087 | D088 | D089 | D090 | pad |
| 3 | D091 | D092 | D093 | D094 | D095 | D096 | D097 | pad |
| 4 | D098 | D099 | D100 | D101 | D102 | D103 | D104 | pad |
| 5 | pad | pad | pad | pad | pad | pad | pad | pad |
z=2
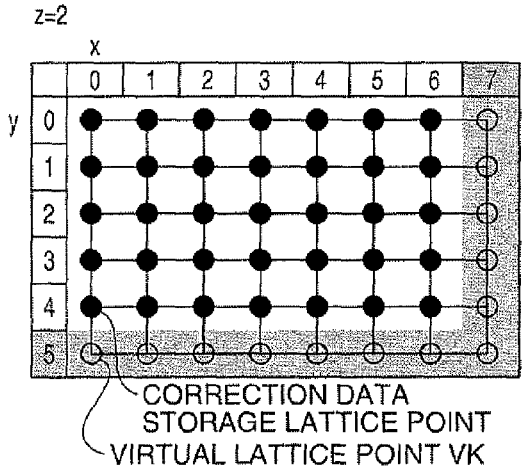
FIG. 10 z=3
| y \ x | 0 | 1 | 2 | 3 | 4 | 5 | 6 | 7 |
|---|---|---|---|---|---|---|---|---|
| 0 | D105 | D106 | D107 | D180 | D109 | D110 | D111 | pad |
| 1 | D112 | D113 | D114 | D115 | D116 | D117 | D118 | pad |
| 2 | D119 | D120 | D121 | D122 | D123 | D124 | D125 | pad |
| 3 | D126 | D127 | D128 | D129 | D130 | D131 | D132 | pad |
| 4 | D133 | D134 | D135 | D136 | D137 | D138 | D139 | pad |
| 5 | pad | pad | pad | pad | pad | pad | pad | pad |
z=3
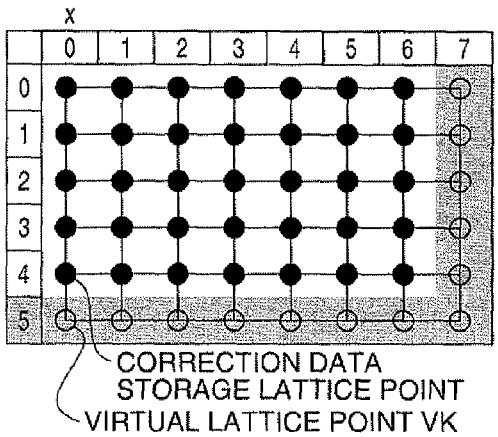
z=4
| y \ x | 0 | 1 | 2 | 3 | 4 | 5 | 6 | 7 |
|---|---|---|---|---|---|---|---|---|
| 0 | D140 | D141 | D142 | D143 | D144 | D145 | D146 | pad |
| 1 | D147 | D148 | D149 | D150 | D151 | D152 | D153 | pad |
| 2 | D154 | D155 | D156 | D157 | D158 | D159 | D160 | pad |
| 3 | D161 | D162 | D163 | D164 | D165 | D166 | D167 | pad |
| 4 | D168 | D169 | D170 | D171 | D172 | D173 | D174 | pad |
| 5 | pad | pad | pad | pad | pad | pad | pad | pad |
z=4
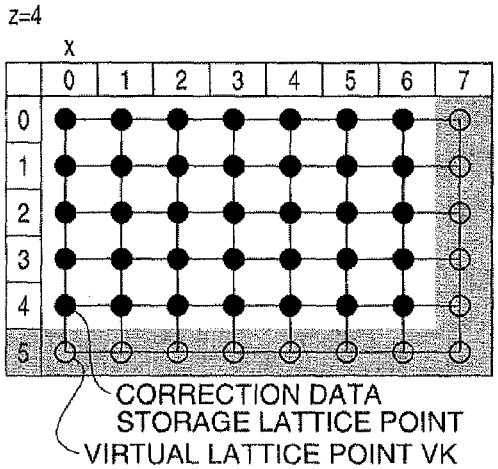
z=5
| y \ x | 0 | 1 | 2 | 3 | 4 | 5 | 6 | 7 |
|---|---|---|---|---|---|---|---|---|
| 0 | D175 | D176 | D177 | D178 | D179 | D180 | D181 | pad |
| 1 | D182 | D183 | D184 | D185 | D186 | D187 | D188 | pad |
| 2 | D189 | D190 | D191 | D192 | D193 | D194 | D195 | pad |
| 3 | D196 | D197 | D198 | D199 | D200 | D201 | D202 | pad |
| 4 | D203 | D204 | D205 | D206 | D207 | D208 | D209 | pad |
| 5 | pad | pad | pad | pad | pad | pad | pad | pad |
z=5
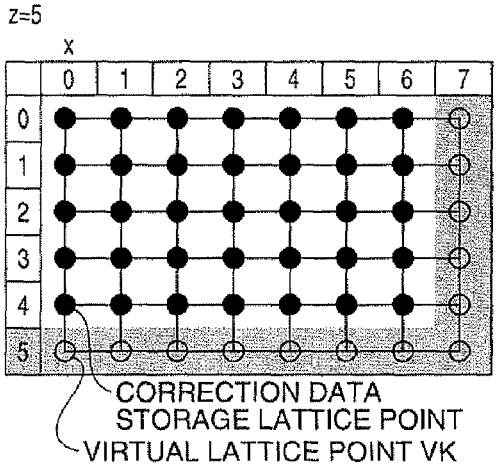
FIG. 11 z=6
| y \ x | 0 | 1 | 2 | 3 | 4 | 5 | 6 | 7 |
|---|---|---|---|---|---|---|---|---|
| 0 | D210 | D211 | D212 | D213 | D214 | D215 | D216 | pad |
| 1 | D217 | D218 | D219 | D220 | D221 | D222 | D223 | pad |
| 2 | D224 | D225 | D226 | D227 | D228 | D229 | D230 | pad |
| 3 | D231 | D232 | D233 | D234 | D235 | D236 | D237 | pad |
| 4 | D238 | D239 | D240 | D241 | D242 | D243 | D244 | pad |
| 5 | pad | pad | pad | pad | pad | pad | pad | pad |
z=6
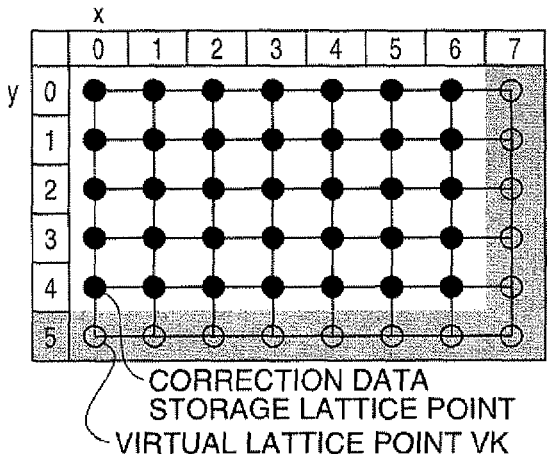
z=7
| y \ x | 0 | 1 | 2 | 3 | 4 | 5 | 6 | 7 |
|---|---|---|---|---|---|---|---|---|
| 0 | D245 | D246 | D247 | D248 | D249 | D250 | D251 | pad |
| 1 | D252 | D253 | D254 | D255 | D256 | D257 | D258 | pad |
| 2 | D259 | D260 | D261 | D262 | D263 | D264 | D265 | pad |
| 3 | D266 | D267 | D268 | D269 | D270 | D271 | D272 | pad |
| 4 | D273 | D274 | D275 | D276 | D277 | D278 | D279 | pad |
| 5 | pad | pad | pad | pad | pad | pad | pad | pad |
z=7
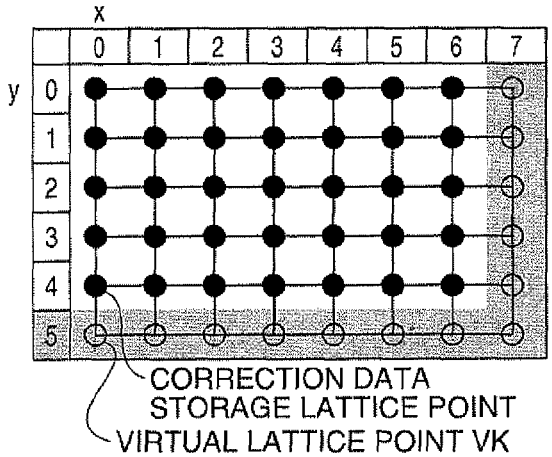
FIG. 12

| x | y | z | MEMORY NO. |
|---|---|---|---|
| EVEN NUMBER | EVEN NUMBER | EVEN NUMBER | FIRST MEMORY |
| (e,e,e) | | | |
| EVEN NUMBER | EVEN NUMBER | ODD NUMBER | SECOND MEMORY |
| (e,e,o) | | | |
| EVEN NUMBER | ODD NUMBER | EVEN NUMBER | THIRD MEMORY |
| (e,o,e) | | | |
| EVEN NUMBER | ODD NUMBER | ODD NUMBER | FOURTH MEMORY |
| (e,o,o) | | | |
| ODD NUMBER | EVEN NUMBER | EVEN NUMBER | FIFTH MEMORY |
| (o,e,e) | | | |
| ODD NUMBER | EVEN NUMBER | ODD NUMBER | SIXTH MEMORY |
| (o,e,o) | | | |
| ODD NUMBER | ODD NUMBER | EVEN NUMBER | SEVENTH MEMORY |
| (o,o,e) | | | |
| ODD NUMBER | ODD NUMBER | ODD NUMBER | EIGHTH MEMORY |
| (o,o,o) | | | |

FIG. 14 z=0

| y \ x | 0 | 1 | 2 | 3 | 4 | 5 | 6 | 7 |
|---|---|---|---|---|---|---|---|---|
| 0 | D000 | D001 | D002 | D003 | D004 | D005 | D006 | pad |
| 1 | D007 | D008 | D009 | D010 | D011 | D012 | D013 | pad |
| 2 | D014 | D015 | D016 | D017 | D018 | D019 | D020 | pad |
| 3 | D021 | D022 | D023 | D024 | D025 | D026 | D027 | pad |
| 4 | D028 | D029 | D030 | D031 | D032 | D033 | D034 | pad |
| 5 | pad | pad | pad | pad | pad | pad | pad | pad |

z=1

| y \ x | 0 | 1 | 2 | 3 | 4 | 5 | 6 | 7 |
|---|---|---|---|---|---|---|---|---|
| 0 | D035 | D036 | D037 | D038 | D039 | D040 | D041 | pad |
| 1 | D042 | D043 | D044 | D045 | D046 | D047 | D048 | pad |
| 2 | D049 | D050 | D051 | D052 | D053 | D054 | D055 | pad |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |

z=2

| y \ x | 0 | 1 | 2 | 3 | 4 | 5 | 6 | 7 |
|---|---|---|---|---|---|---|---|---|
| 0 | D070 | D071 | D072 | D073 | D074 | D075 | D076 | pad |
| 1 | D077 | D078 | D079 | D080 | D081 | D082 | D083 | pad |
| 2 | D084 | D085 | D086 | D087 | D088 | D089 | D090 | pad |
| 3 | D091 | D092 | D093 | D094 | D095 | D096 | D097 | pad |
| 4 | D098 | D099 | D100 | D101 | D102 | D103 | D104 | pad |
| 5 | pad | pad | pad | pad | pad | pad | pad | pad |

FIG. 18 z=3

| y \ x | 0 | 1 | 2 | 3 | 4 | 5 | 6 | 7 |
|---|---|---|---|---|---|---|---|---|
| 0 | D105 | D106 | D107 | D180 | D109 | D110 | D111 | pad |
| 1 | D112 | D113 | D114 | D115 | D116 | D117 | D118 | pad |
| 2 | D119 | D120 | D121 | D122 | D123 | D124 | D125 | pad |
| 3 | D126 | D127 | D128 | D129 | D130 | D131 | D132 | pad |
| 4 | D133 | D134 | D135 | D136 | D137 | D138 | D139 | pad |
| 5 | pad | pad | pad | pad | pad | pad | pad | pad |

z=4

| y \ x | 0 | 1 | 2 | 3 | 4 | 5 | 6 | 7 |
|---|---|---|---|---|---|---|---|---|
| 0 | D140 | D141 | D142 | D143 | D144 | D145 | D146 | pad |
| 1 | D147 | D148 | D149 | D150 | D151 | D152 | D153 | pad |
| 2 | D154 | D155 | D156 | D157 | D158 | D159 | D160 | pad |
| 3 | D161 | D162 | D163 | D164 | D165 | D166 | D167 | pad |
| 4 | D168 | D169 | D170 | D171 | D172 | D173 | D174 | pad |
| 5 | pad | pad | pad | pad | pad | pad | pad | pad |

z=5

| y \ x | 0 | 1 | 2 | 3 | 4 | 5 | 6 | 7 |
|---|---|---|---|---|---|---|---|---|
| 0 | D175 | D176 | D177 | D178 | D179 | D180 | D181 | pad |
| 1 | D182 | D183 | D184 | D185 | D186 | D187 | D188 | pad |
| 2 | D189 | D190 | D191 | D192 | D193 | D194 | D195 | pad |
| 3 | D196 | D197 | D198 | D199 | D200 | D201 | D202 | pad |
| 4 | D203 | D204 | D205 | D206 | D207 | D208 | D209 | pad |
| 5 | pad | pad | pad | pad | pad | pad | pad | pad |

FIG. 19 z=6

| y \ x | 0 | 1 | 2 | 3 | 4 | 5 | 6 | 7 |
|---|---|---|---|---|---|---|---|---|
| 0 | D210 | D211 | D212 | D213 | D214 | D215 | D216 | pad |
| 1 | D217 | D218 | D219 | D220 | D221 | D222 | D223 | pad |
| 2 | D224 | D225 | D226 | D227 | D228 | D229 | D230 | pad |
| 3 | D231 | D232 | D233 | D234 | D235 | D236 | D237 | pad |
| 4 | D238 | D239 | D240 | D241 | D242 | D243 | D244 | pad |
| 5 | pad | pad | pad | pad | pad | pad | pad | pad |

z=7

| y \ x | 0 | 1 | 2 | 3 | 4 | 5 | 6 | 7 |
|---|---|---|---|---|---|---|---|---|
| 0 | D245 | D246 | D247 | D248 | D249 | D250 | D251 | pad |
| 1 | D252 | D253 | D254 | D255 | D256 | D257 | D258 | pad |
| 2 | D259 | D260 | D261 | D262 | D263 | D264 | D265 | pad |
| 3 | D266 | D267 | D268 | D269 | D270 | D271 | D272 | pad |
| 4 | D273 | D274 | D275 | D276 | D277 | D278 | D279 | pad |
| 5 | pad | pad | pad | pad | pad | pad | pad | pad |

FIG. 20

FIG. 23A

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | | | | | | | | | | | | |
| THIRD MEMORY | (e,o,e) | D007 | D009 | D011 | D013 | D021 | D023 | D025 | D027 | | | | |
| FOURTH MEMORY | (e,o,o) | | | | | | | | | | | | |
| FIFTH MEMORY | (o,e,e) | D001 | D003 | D005 | pad | D015 | D017 | D019 | pad | D029 | D031 | D033 | pad |
| SIXTH MEMORY | (o,e,o) | | | | | | | | | | | | |
| SEVENTH MEMORY | (o,o,e) | D008 | D010 | D012 | pad | D022 | D024 | D026 | pad | | | | |
| EIGHTH MEMORY | (o,o,o) | | | | | | | | | | | | |

z=0

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | | | | | | | | |
| 4 | D028 | D029 | D030 | D031 | D032 | D033 | D034 | pad |
| 5 | pad | pad | pad | pad | pad | pad | pad | pad |

FIG. 23B

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | | | | | | | | | | | | |
| THIRD MEMORY | (e,o,e) | D007 | D009 | D011 | D013 | D021 | D023 | D025 | D027 | pad | pad | pad | pad |
| FOURTH MEMORY | (e,o,o) | | | | | | | | | | | | |
| FIFTH MEMORY | (o,e,e) | D001 | D003 | D005 | pad | D015 | D017 | D019 | pad | D029 | D031 | D033 | pad |
| SIXTH MEMORY | (o,e,o) | | | | | | | | | | | | |
| SEVENTH MEMORY | (o,o,e) | D008 | D010 | D012 | pad | D022 | D024 | D026 | pad | pad | pad | pad | pad |
| EIGHTH MEMORY | (o,o,o) | | | | | | | | | | | | |

z=0

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | | | | | | | | |
| 4 | | | | | | | | |
| 5 | pad | pad | pad | pad | pad | pad | pad | pad |

FIG. 24A

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | D035 | D037 | D039 | D041 | | | | | | | | |
| THIRD MEMORY | (e,o,e) | D007 | D009 | D011 | D013 | D021 | D023 | D025 | D027 | pad | pad | pad | pad |
| FOURTH MEMORY | (e,o,o) | | | | | | | | | | | | |
| FIFTH MEMORY | (o,e,e) | D001 | D003 | D005 | pad | D015 | D017 | D019 | pad | D029 | D031 | D033 | pad |
| SIXTH MEMORY | (o,e,o) | D036 | D038 | D040 | pad | | | | | | | | |
| SEVENTH MEMORY | (o,o,e) | D008 | D010 | D012 | pad | D022 | D024 | D026 | pad | pad | pad | pad | pad |
| EIGHTH MEMORY | (o,o,o) | | | | | | | | | | | | |

z=1

| y \ x | 0 | 1 | 2 | 3 | 4 | 5 | 6 | 7 |
|---|---|---|---|---|---|---|---|---|
| 0 | D035 | D036 | D037 | D038 | D039 | D040 | D041 | pad |
| 1 | D042 | D043 | D044 | D045 | D046 | D047 | D048 | pad |
| 2 | D049 | D050 | D051 | D052 | D053 | D054 | D055 | pad |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |

FIG. 24B

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | D035 | D037 | D039 | D041 | | | | | | | | |
| THIRD MEMORY | (e,o,e) | D007 | D009 | D011 | D013 | D021 | D023 | D025 | D027 | pad | pad | pad | pad |
| FOURTH MEMORY | (e,o,o) | D042 | D044 | D046 | D048 | | | | | | | | |
| FIFTH MEMORY | (o,e,e) | D001 | D003 | D005 | pad | D015 | D017 | D019 | pad | D029 | D031 | D033 | pad |
| SIXTH MEMORY | (o,e,o) | D036 | D038 | D040 | pad | | | | | | | | |
| SEVENTH MEMORY | (o,o,e) | D008 | D010 | D012 | pad | D022 | D024 | D026 | pad | pad | pad | pad | pad |
| EIGHTH MEMORY | (o,o,o) | D043 | D045 | D047 | pad | | | | | | | | |

z=1

| y \ x | 0 | 1 | 2 | 3 | 4 | 5 | 6 | 7 |
|---|---|---|---|---|---|---|---|---|
| 0 | | | | | | | | |
| 1 | D042 | D043 | D044 | D045 | D046 | D047 | D048 | pad |
| 2 | D049 | D050 | D051 | D052 | D053 | D054 | D055 | pad |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |

FIG. 25A

ADDRESS

| | x | y | z | add0 | add1 | add2 | add3 | add4 | add5 | add6 | add7 | add8 | add9 | add10 | add11 |
|---|---|---|---|---|---|---|---|---|---|---|---|---|---|---|---|
| FIRST MEMORY | | | (e,e,e) | D000 | D002 | D004 | D006 | D014 | D016 | D018 | D020 | D028 | D030 | D032 | D034 |
| SECOND MEMORY | | | (e,e,o) | D035 | D037 | D039 | D041 | D049 | D051 | D053 | D055 | | | | |
| THIRD MEMORY | | | (e,o,e) | D007 | D009 | D011 | D013 | D021 | D023 | D025 | D027 | pad | pad | pad | pad |
| FOURTH MEMORY | | | (e,o,o) | D042 | D044 | D046 | D048 | | | | | | | | |
| FIFTH MEMORY | | | (o,e,e) | D001 | D003 | D005 | pad | D015 | D017 | D019 | pad | D029 | D031 | D033 | pad |
| SIXTH MEMORY | | | (o,e,o) | D036 | D038 | D040 | pad | D050 | D052 | D054 | pad | | | | |
| SEVENTH MEMORY | | | (o,o,e) | D008 | D010 | D012 | pad | D022 | D024 | D026 | pad | pad | pad | pad | pad |
| EIGHTH MEMORY | | | (o,o,o) | D043 | D045 | D047 | pad | | | | | | | | |

z=1

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | D049 | D050 | D051 | D052 | D053 | D054 | D055 | pad |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |

FIG. 25B

ADDRESS

| | x | y | z | add0 | add1 | add2 | add3 | add4 | add5 | add6 | add7 | add8 | add9 | add10 | add11 |
|---|---|---|---|---|---|---|---|---|---|---|---|---|---|---|---|
| FIRST MEMORY | | | (e,e,e) | D000 | D002 | D004 | D006 | D014 | D016 | D018 | D020 | D028 | D030 | D032 | D034 |
| SECOND MEMORY | | | (e,e,o) | D035 | D037 | D039 | D041 | D049 | D051 | D053 | D055 | | | | |
| THIRD MEMORY | | | (e,o,e) | D007 | D009 | D011 | D013 | D021 | D023 | D025 | D027 | pad | pad | pad | pad |
| FOURTH MEMORY | | | (e,o,o) | D042 | D044 | D046 | D048 | D056 | D058 | D060 | D062 | | | | |
| FIFTH MEMORY | | | (o,e,e) | D001 | D003 | D005 | pad | D015 | D017 | D019 | pad | D029 | D031 | D033 | pad |
| SIXTH MEMORY | | | (o,e,o) | D036 | D038 | D040 | pad | D050 | D052 | D054 | pad | | | | |
| SEVENTH MEMORY | | | (o,o,e) | D008 | D010 | D012 | pad | D022 | D024 | D026 | pad | pad | pad | pad | pad |
| EIGHTH MEMORY | | | (o,o,o) | D043 | D045 | D047 | pad | D057 | D059 | D061 | pad | | | | |

z=1

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | D056 | D057 | D058 | D059 | D060 | D061 | D062 | pad |
| 4 | D063 | D064 | D065 | D066 | D067 | D068 | D069 | pad |
| 5 | pad | pad | pad | pad | pad | pad | pad | pad |

FIG. 26A

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | D035 | D037 | D039 | D041 | D049 | D051 | D053 | D055 | D063 | D065 | D067 | D069 |
| THIRD MEMORY | (e,o,e) | D007 | D009 | D011 | D013 | D021 | D023 | D025 | D027 | pad | pad | pad | pad |
| FOURTH MEMORY | (e,o,o) | D042 | D044 | D046 | D048 | D056 | D058 | D060 | D062 | | | | |
| FIFTH MEMORY | (o,e,e) | D001 | D003 | D005 | pad | D015 | D017 | D018 | pad | D029 | D031 | D033 | pad |
| SIXTH MEMORY | (o,e,o) | D036 | D038 | D040 | pad | D050 | D052 | D054 | pad | D064 | D066 | D068 | pad |
| SEVENTH MEMORY | (o,o,e) | D008 | D010 | D012 | pad | D022 | D024 | D026 | pad | pad | pad | pad | pad |
| EIGHTH MEMORY | (o,o,o) | D043 | D045 | D047 | pad | D057 | D059 | D061 | pad | | | | |

z=1

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | | | | | | | | |
| 4 | D063 | D064 | D065 | D066 | D067 | D068 | D069 | pad |
| 5 | pad | pad | pad | pad | pad | pad | pad | pad |

FIG. 26B

ADDRESS

| | x y z | add0 | add1 | add2 | add3 | add4 | add5 | add6 | add7 | add8 | add9 | add10 | add11 |
|---|---|---|---|---|---|---|---|---|---|---|---|---|---|
| FIRST MEMORY | (e,e,e) | D000 | D002 | D004 | D006 | D014 | D016 | D018 | D020 | D028 | D030 | D032 | D034 |
| SECOND MEMORY | (e,e,o) | D035 | D037 | D039 | D041 | D049 | D051 | D053 | D055 | D063 | D065 | D067 | D069 |
| THIRD MEMORY | (e,o,e) | D007 | D009 | D011 | D013 | D021 | D023 | D025 | D027 | pad | pad | pad | pad |
| FOURTH MEMORY | (e,o,o) | D042 | D044 | D046 | D048 | D056 | D058 | D060 | D062 | pad | pad | pad | pad |
| FIFTH MEMORY | (o,e,e) | D001 | D003 | D005 | pad | D015 | D017 | D019 | pad | D029 | D031 | D033 | pad |
| SIXTH MEMORY | (o,e,o) | D036 | D038 | D040 | pad | D050 | D052 | D054 | pad | D064 | D066 | D068 | pad |
| SEVENTH MEMORY | (o,o,e) | D008 | D010 | D012 | pad | D022 | D024 | D026 | pad | pad | pad | pad | pad |
| EIGHTH MEMORY | (o,o,o) | D043 | D045 | D047 | pad | D057 | D059 | D061 | pad | pad | pad | pad | pad |

z=1

| y \ x | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | | | | | | | | |
| 4 | | | | | | | | |
| 5 | pad | pad | pad | pad | pad | pad | pad | pad |

FIG. 27A z=2~3

| | x \| y \| z | ADDRESS | | | | | | | | | | | |
|---|---|---|---|---|---|---|---|---|---|---|---|---|---|
| | | add12 | add13 | add14 | add15 | add16 | add17 | add18 | add19 | add20 | add21 | add22 | add23 |
| FIRST MEMORY | (e,e,e) | D070 | D072 | D074 | D076 | D084 | D086 | D088 | D090 | D098 | D100 | D102 | D104 |
| SECOND MEMORY | (e,e,o) | D105 | D107 | D109 | D111 | D119 | D121 | D123 | D125 | D133 | D135 | D137 | D139 |
| THIRD MEMORY | (e,o,e) | D077 | D079 | D081 | D083 | D091 | D093 | D095 | D097 | pad | pad | pad | pad |
| FOURTH MEMORY | (e,o,o) | D112 | D114 | D116 | D118 | D126 | D128 | D130 | D132 | pad | pad | pad | pad |
| FIFTH MEMORY | (o,e,e) | D071 | D073 | D075 | pad | D085 | D087 | D089 | pad | D099 | D101 | D103 | pad |
| SIXTH MEMORY | (o,e,o) | D106 | D108 | D110 | pad | D120 | D122 | D124 | pad | D134 | D136 | D138 | pad |
| SEVENTH MEMORY | (o,o,e) | D078 | D080 | D082 | pad | D092 | D094 | D096 | pad | pad | pad | pad | pad |
| EIGHTH MEMORY | (o,o,o) | D113 | D115 | D117 | pad | D127 | D129 | D131 | pad | pad | pad | pad | pad |

FIG. 27B z=4~5

| | x \| y \| z | ADDRESS | | | | | | | | | | | |
|---|---|---|---|---|---|---|---|---|---|---|---|---|---|
| | | add24 | add25 | add26 | add27 | add28 | add29 | add30 | add31 | add32 | add33 | add34 | add35 |
| FIRST MEMORY | (e,e,e) | D140 | D142 | D144 | D146 | D154 | D156 | D158 | D160 | D168 | D170 | D172 | D174 |
| SECOND MEMORY | (e,e,o) | D175 | D177 | D179 | D181 | D189 | D191 | D193 | D195 | D203 | D205 | D207 | D209 |
| THIRD MEMORY | (e,o,e) | D147 | D149 | D151 | D153 | D161 | D163 | D165 | D167 | pad | pad | pad | pad |
| FOURTH MEMORY | (e,o,o) | D182 | D184 | D186 | D188 | D196 | D198 | D200 | D202 | pad | pad | pad | pad |
| FIFTH MEMORY | (o,e,e) | D141 | D143 | D145 | pad | D165 | D167 | D169 | pad | D169 | D171 | D173 | pad |
| SIXTH MEMORY | (o,e,o) | D176 | D178 | D180 | pad | D190 | D192 | D194 | pad | D204 | D206 | D208 | pad |
| SEVENTH MEMORY | (o,o,e) | D148 | D150 | D152 | pad | D162 | D164 | D166 | pad | pad | pad | pad | pad |
| EIGHTH MEMORY | (o,o,o) | D183 | D185 | D187 | pad | D197 | D199 | D201 | pad | pad | pad | pad | pad |

FIG. 27B z=6~7

| | x \| y \| z | ADDRESS | | | | | | | | | | | |
|---|---|---|---|---|---|---|---|---|---|---|---|---|---|
| | | add36 | add37 | add38 | add39 | add40 | add41 | add42 | add43 | add44 | add45 | add46 | add47 |
| FIRST MEMORY | (e,e,e) | D210 | D212 | D214 | D216 | D224 | D226 | D228 | D230 | D238 | D240 | D242 | D244 |
| SECOND MEMORY | (e,e,o) | D245 | D247 | D249 | D241 | D259 | D261 | D263 | D265 | D273 | D275 | D277 | D279 |
| THIRD MEMORY | (e,o,e) | D217 | D219 | D221 | D223 | D231 | D233 | D235 | D237 | pad | pad | pad | pad |
| FOURTH MEMORY | (e,o,o) | D252 | D254 | D256 | D258 | D266 | D268 | D270 | D272 | pad | pad | pad | pad |
| FIFTH MEMORY | (o,e,e) | D211 | D213 | D215 | pad | D225 | D227 | D229 | pad | D239 | D241 | D243 | pad |
| SIXTH MEMORY | (o,e,o) | D246 | D248 | D250 | pad | D260 | D262 | D264 | pad | D274 | D276 | D278 | pad |
| SEVENTH MEMORY | (o,o,e) | D218 | D220 | D222 | pad | D232 | D234 | D236 | pad | pad | pad | pad | pad |
| EIGHTH MEMORY | (o,o,o) | D253 | D255 | D257 | pad | D267 | D269 | D271 | pad | pad | pad | pad | pad |

z=0~1

| | x y z | ADDRESS | | | | | | | | | | | |
|---|---|---|---|---|---|---|---|---|---|---|---|---|---|
| | | add0 | add1 | add2 | add3 | add4 | add5 | add6 | add7 | add8 | add9 | add10 | add11 |
| FIRST MEMORY | (e,e,e) | D000 | D002 | D004 | D006 | D014 | D016 | D018 | D020 | D028 | D030 | D032 | D034 |
| SECOND MEMORY | (e,e,o) | D035 | D037 | D039 | D041 | D049 | D051 | D053 | D055 | D063 | D065 | D067 | D069 |
| THIRD MEMORY | (e,o,e) | D007 | D009 | D011 | D013 | D021 | D023 | D025 | D027 | D028 | D030 | D032 | D034 |
| FOURTH MEMORY | (e,o,o) | D042 | D044 | D046 | D048 | D056 | D058 | D060 | D062 | D063 | D065 | D067 | D069 |
| FIFTH MEMORY | (o,e,e) | D001 | D003 | D005 | D006 | D015 | D017 | D019 | D020 | D029 | D031 | D033 | D034 |
| SIXTH MEMORY | (o,e,o) | D036 | D038 | D040 | D041 | D050 | D052 | D054 | D055 | D064 | D066 | D068 | D069 |
| SEVENTH MEMORY | (o,o,e) | D008 | D010 | D012 | D013 | D022 | D024 | D026 | D027 | D029 | D031 | D033 | D034 |
| EIGHTH MEMORY | (o,o,o) | D043 | D045 | D047 | D048 | D057 | D059 | D061 | D062 | D064 | D066 | D068 | D069 |

FIG. 29A z=2~3

| | x y z | ADDRESS | | | | | | | | | | | |
|---|---|---|---|---|---|---|---|---|---|---|---|---|---|
| | | add12 | add13 | add14 | add15 | add16 | add17 | add18 | add19 | add20 | add21 | add22 | add23 |
| FIRST MEMORY | (e,e,e) | D070 | D072 | D074 | D076 | D084 | D086 | D088 | D090 | D098 | D100 | D102 | D104 |
| SECOND MEMORY | (e,e,o) | D105 | D107 | D109 | D111 | D119 | D121 | D123 | D125 | D133 | D135 | D137 | D139 |
| THIRD MEMORY | (e,o,e) | D077 | D079 | D081 | D083 | D091 | D093 | D095 | D097 | D098 | D100 | D102 | D104 |
| FOURTH MEMORY | (e,o,o) | D112 | D114 | D116 | D118 | D126 | D128 | D130 | D132 | D133 | D135 | D137 | D139 |
| FIFTH MEMORY | (o,e,e) | D071 | D073 | D075 | D076 | D085 | D087 | D089 | D090 | D099 | D101 | D103 | D104 |
| SIXTH MEMORY | (o,e,o) | D106 | D108 | D110 | D111 | D120 | D122 | D124 | D125 | D134 | D136 | D138 | D139 |
| SEVENTH MEMORY | (o,o,e) | D078 | D080 | D082 | D083 | D092 | D094 | D096 | D097 | D099 | D101 | D103 | D104 |
| EIGHTH MEMORY | (o,o,o) | D113 | D115 | D117 | D118 | D127 | D129 | D131 | D132 | D134 | D136 | D138 | D139 |

FIG. 29B z=4~5

| | x y z | ADDRESS | | | | | | | | | | | |
|---|---|---|---|---|---|---|---|---|---|---|---|---|---|
| | | add24 | add25 | add26 | add27 | add28 | add29 | add30 | add31 | add32 | add33 | add34 | add35 |
| FIRST MEMORY | (e,e,e) | D140 | D142 | D144 | D146 | D154 | D156 | D158 | D160 | D168 | D170 | D172 | D174 |
| SECOND MEMORY | (e,e,o) | D175 | D177 | D179 | D181 | D189 | D191 | D193 | D195 | D203 | D205 | D207 | D209 |
| THIRD MEMORY | (e,o,e) | D147 | D149 | D151 | D153 | D161 | D163 | D165 | D167 | D168 | D170 | D172 | D174 |
| FOURTH MEMORY | (e,o,o) | D182 | D184 | D186 | D188 | D196 | D198 | D200 | D202 | D203 | D205 | D207 | D209 |
| FIFTH MEMORY | (o,e,e) | D141 | D143 | D145 | D146 | D155 | D157 | D159 | D160 | D169 | D171 | D173 | D174 |
| SIXTH MEMORY | (o,e,o) | D176 | D178 | D180 | D181 | D190 | D192 | D194 | D195 | D204 | D206 | D208 | D209 |
| SEVENTH MEMORY | (o,o,e) | D148 | D150 | D152 | D153 | D162 | D164 | D166 | D167 | D169 | D171 | D173 | D174 |
| EIGHTH MEMORY | (o,o,o) | D183 | D185 | D187 | D188 | D197 | D199 | D201 | D202 | D204 | D206 | D208 | D209 |

FIG. 29C z=6~7

| | x y z | ADDRESS | | | | | | | | | | | |
|---|---|---|---|---|---|---|---|---|---|---|---|---|---|
| | | add36 | add37 | add38 | add39 | add40 | add41 | add42 | add43 | add44 | add45 | add46 | add47 |
| FIRST MEMORY | (e,e,e) | D210 | D212 | D214 | D216 | D224 | D226 | D228 | D230 | D238 | D240 | D242 | D244 |
| SECOND MEMORY | (e,e,o) | D245 | D247 | D249 | D251 | D259 | D261 | D263 | D265 | D273 | D275 | D277 | D279 |
| THIRD MEMORY | (e,o,e) | D217 | D219 | D221 | D223 | D231 | D233 | D235 | D237 | D238 | D240 | D242 | D244 |
| FOURTH MEMORY | (e,o,o) | D252 | D254 | D256 | D258 | D266 | D268 | D270 | D272 | D273 | D275 | D277 | D279 |
| FIFTH MEMORY | (o,e,e) | D211 | D213 | D215 | D216 | D225 | D227 | D229 | D230 | D239 | D241 | D243 | D244 |
| SIXTH MEMORY | (o,e,o) | D246 | D248 | D250 | D251 | D260 | D262 | D264 | D265 | D274 | D276 | D278 | D279 |
| SEVENTH MEMORY | (o,o,e) | D218 | D220 | D222 | D223 | D232 | D234 | D236 | D237 | D239 | D241 | D243 | D244 |
| EIGHTH MEMORY | (o,o,o) | D253 | D255 | D257 | D258 | D267 | D269 | D271 | D272 | D274 | D276 | D278 | D279 |

FIG. 29D

DATA CONVERSION APPARATUS AND DATA CONVERSION METHOD

BACKGROUND

1. Technical Field

The present invention relates to an apparatus for converting converted data that belongs to an m-axis (where, m is an integer that is equal to or larger than 2) data space and a method thereof.

2. Related Art

In the case of displaying a still image or an image on a display screen of a light modulation device such as a liquid crystal display panel, image data that forms such an image is generally converted into data that is suitable to be output to pixels that constitute a display screen to be output. In a printing technology field, not limited to the image display, RGB image data is converted into ink colors that can be processed in a printer. In such a data conversion, a lookup table is commonly used to mediate simplicity in the conversion process (for example, see JP-A-2001-36755).

JP-A-2001-36755 discloses the use of a 3-dimensional lookup table (hereinafter referred to as a "3D-LUT") in which respective RGB axes have the same number n of lattice points in order to convert data in a color space that is represented by three data axes of RGB into data in another color space. According to this 3D-LUT, a 3D square lattice is provided with $n^3$ lattice points, and correction data for data conversion at respective lattice points are stored in eight memories that corresponds to the number $2^3$ of lattice points of the square lattice. In storing the correction data, correction data of the respective lattice points are sequentially stored in the eight memories in combination of even and odd numbers of three-axis coordinate numbers in observing the combination of the even and odd numbers of the coordinate numbers of the three axes of RGB in the case where the lattice points of the respective axes are inscribed by positive integers starting from zero in the range of 0 to n−1 on the three-axis coordinates of RGB. Also, eight lattice points that surround a conversion target point having data that is the subject of data conversion are obtained, and data (RGB data) on the conversion target point is data-converted through reception of the correction data that the respective lattice points have in a complementary computation technique.

The data conversion technique using the 3D-LUT may also be applied to a case where a still image or a video is displayed on the display screen such as a liquid crystal display panel or the like based on the image data in addition to the above-described color conversion. That is, if it is assumed that the length and breadth of an image that is displayed on a liquid crystal display panel or the like are represented by x and y-axes and a gray scale when gray scale expression is performed for each pixel is represented by a z-axis, the image data that corresponds to each pixel becomes data indicated on three data axes, and thus the correction of the image data that corresponds to the pixel can be performed by a data conversion technique using the 3D-LUT. However, since there is a restriction in that the respective axes of the 3D-LUT have the same number of lattice points and the correction data at the respective lattice points is stored in eight memories that correspond to the number of lattice points of the square lattice, there is a need for improvement of its genericity as described below.

In the case of performing a high-resolution image display in the liquid crystal display panel, the aspect ratio of the liquid crystal display panel is sometimes different, and thus the length of the x-axis is different from the length of the y-axis in the display area of an image. Because of this, the number of lattice points on the x-axis may be different from the number of lattice points on the y-axis. However, according to the above-described technique, due to the limitation in that the respective x, y, and z-axes have the same number of lattice points, an address operation for storing data that is different from that in the above-described technique is required and thus its improvement is required.

SUMMARY

An advantage of some aspects of the invention is to heighten the genericity of a 3D-LUT which is used to convert converted data that belongs to an m-axis (where, m is an integer that is equal to or larger than 2) data space, for example, a three-axis data space.

Application 1: Data Conversion Apparatus

A data conversion apparatus for converting converted data that belongs to an m-axis (where, m is an integer that is equal to or larger than 2) data space, includes a data storage unit that stores correction data at respective lattice points of an m-dimensional lookup table, in which each of the m axes is divided into two or more lattice points, and the correction data for correcting the converted data in correspondence to input values of the converted data are provided for the respective lattice points obtained from the respective lattice type axes, in a first to an N-th (where, N is $2^m$) memories; and a data conversion unit that reads the correction data at the lattice points positioned around the converted data from the first to N-th memories with reference to the m-dimensional lookup table, and converts the converted data based on the read correction data; wherein the data storage unit assumes a virtual m-dimensional lookup table, which has an axis in which one virtual lattice point is included on the side of an end portion of the axis, in which the correction data is prepared and the number of the lattice points is an odd number, and the number of lattice points is an even number among the respective axes, a lattice type axis that is different from the axis that includes the virtual lattice points, and the virtual lattice points and lattice points except for the virtual lattice points, and then allocates data to the virtual lattice points, and the data storage unit stores the data at the respective lattice points and the correction data at the lattice points except for the virtual lattice points in the virtual m-dimensional lookup table in the first to N-th memories.

In the data conversion apparatus having the above-described configuration, if the data space to which the converted data belongs is considered as a three-axis data space, the m-dimensional lookup table is considered as a 3D lookup table in which respective x, y, and z-axes corresponding to the above-described three axes are in the form of a lattice in order to convert the converted data that belongs to the three-axis data space; and the data storage unit assumes a virtual 3D lookup table, which has an axis in which one virtual lattice point is included on the side of an end portion of the axis, in which the correction data is prepared and the number of the lattice points is an odd number, and the number of lattice points is an even number among the respective x, y, and z-axes in the 3D lookup table, a lattice type axis that is different from the axis that includes the virtual lattice points, and the virtual lattice points and lattice points except for the virtual lattice points, and then allocates data also to the virtual lattice points, and the data storage unit stores the data at the respective virtual lattice points and the correction data at the lattice points except for the virtual lattice points in the virtual 3D lookup table in the first to eighth memories.

In the data conversion apparatus having the above-described configuration, if the numbers of lattice points on the respective x, y, and z-axes are all even numbers in the 3D lookup table (3D-LUT), the data storage unit does not assume a virtual 3D lookup table (virtual 3D-LUT), whereas if the number of lattice points is an odd number on any one of the x, y, and z-axes, the data storage unit assumes a virtual 3D lookup table, which has an axis in which one virtual lattice point is included on the side of an end portion of the axis and thus the number of lattice points becomes an even number, in which the correction data is prepared and the number of the lattice points is an odd number, and the number of lattice points is an even number among the respective x, y, and z-axes in the 3D lookup table, a lattice type axis that is different from the axis that includes the virtual lattice points, and the virtual lattice points and lattice points except for the virtual lattice points, and then allocates data also to the virtual lattice points. This will be described as an example.

If it is assumed that the numbers of lattice points of the x, y, and z-axes are all 8, the 3D lookup table of a lattice type in up, down, left, and right directions on the x, y, and z-axes is not assumed as a virtual 3D lookup table, and has correction data on the respective lattice points (8×8×8=512 lattice points). In this case, in order to closely discriminate between the 3D lookup table and the virtual 3D lookup table, the 3D lookup table that is not assumed as the virtual lookup table because the numbers of lattice points on the respective axes are all the even numbers will be called a normal 3D lookup table.

On the other hand, if any one of the x, y, and z-axes is an axis having odd-numbered lattice points, for example, in the case of the 3D lookup table in which the x-axis is an axis having 7 lattice points (hereinafter, for convenience in explanation, referred to as an "odd-numbered axis 3D lookup table"), one virtual lattice point is added to the end portion of the x-axis to make the x-axis having 8 (even number) lattice points. Further, a virtual 3D lookup table, which has the virtual lattice point and the lattice points except for the virtual lattice point, in the form of a lattice on the x-axis including the virtual lattice point, the y-axis, and the z-axis is assumed. Even this virtual 3D lookup table has 512 (=8×8×8) lattice points including the virtual lattice point, and in the numbers of lattice points on the respective axes, the total number of lattice points, and the arrangement in the form of a lattice of the lattice points, the virtual 3D lookup table completely becomes equal to the normal 3D lookup table in which the numbers of lattice points on the respective axes are even numbers.

Further, the virtual 3D lookup table has the correction data at the lattice points that are not the virtual lattice points, and data is allocated also to the virtual lattice points. The data allocated to the virtual lattice points includes data that indicates there is no correction data or the correction data for the lattice points except for the virtual lattice points that are adjacent to the virtual lattice points. Accordingly, the virtual 3D lookup table becomes equal to the normal 3D lookup table even on the point that the data is provided at the respective lattice points although the data property or the data generation technique of the virtual 3D lookup table is different from that of the normal 3D lookup table. Because of this, the same address operation for recording the data for storing the correction data at each lattice point in the first to eighth memories can be applied to the case where the correction data at each lattice point of the virtual 3D lookup table is stored and to the case where the correction data at each lattice point including the virtual lattice point of the virtual 3D lookup table. This means the followings.

The normal 3D lookup table includes lattice points that correspond to virtual lattice points of the virtual 3D lookup table (hereinafter, for convenience in explanation, referred to as "lattice points corresponding to virtual lattice points"), and the storage memories (first to eighth memories) in which data at the lattice points corresponding to the virtual lattice points are stored through the address operation for recording the data and their addresses become equal to the storage memories (first to eighth memories) in which data at the virtual lattice points of the virtual 3D lookup table are stored through the address operation for reading the data and their addresses. Further, the lattice points corresponding to the virtual lattice points are different from the virtual lattice points only on the point that the former corresponds to the correction data and the latter corresponds to non-data or the correction data at the neighboring lattice points, which are the data property and the data generation technique.

As described above, since the normal 3D lookup table and the virtual 3D lookup table are equal to each other on the point of the number of lattice points and the arrangement of the lattice points and on the point that the respective lattice points have data, the same address operation for reading the data for reading the correction data at the lattice points positioned in the neighborhood of the converted data from the first to eighth memories can be applied to the case where the correction data is read from the lattice points of the normal 3D lookup table and to the case where the correction data is read from the lattice points of the virtual 3D lookup table. Further, there occurs no conflict in reading data from the lattice points of the virtual 3D lookup table which have passed through the address operation for reading the data. Hereinafter, this point will be described.

The basic lookup table that assumes the virtual 3D lookup table is an odd-numbered axis 3D lookup table in the form of a lattice in up, down, left, and right directions on the x-axis having seven lattice points and y and z-axes having eight lattice points. The lattice points having the correction data for converting the converted data in the odd-numbered axis 3D lookup table are not determined as the virtual lattice points in the virtual 3D lookup table, but become the lattice points except for the virtual lattice points in the virtual 3D lookup table. On the other hand, the converted data is not positioned outside the outermost lattice points in the odd-numbered axis 3D lookup table, and in the address operation for reading the data to convert the converted data, the lattice points that are outside the outermost lattice points in the odd-numbered axis 3D lookup table, that is, the virtual lattice points in the virtual 3D lookup table, cannot become the subject of the address operation for reading the data. Accordingly, in reading data from the lattice points of the virtual 3D lookup table, which have passed through the address operation for reading the data, the virtual lattice points do not take part in the address operation, and thus if the data in the virtual 3D lookup table is read in the same address operation for reading the data, the reading of the correction data in the odd-numbered axis 3D lookup table, which become the basis for assuming the virtual 3D lookup table, can be performed with no harm.

For example, even if the converted data is positioned outside the outermost lattice points in the odd-numbered axis 3D lookup table, in the address operation for reading the data to convert the converted data, the data read from the virtual lattice points in the virtual 3D lookup table are equal to the correction data at lattice points in the neighborhood of the corresponding virtual lattice points, and thus big data conversion error does not occur in the results of converting the converted data using the correction data at the read virtual lattice points.

In the address operation for recording and reading the data as described above, if the number of lattice points on any one of the x, y, and z-axes is the odd number, it is not required for the number of lattice points on the respective axes in the virtual 3D lookup table which includes one virtual lattice point to become the same even number. For example, the address operation can be applied also to the odd-numbered axis 3D lookup table in which the number of lattice points on the x-axis is 7, the number of lattice points on the y-axis is 5, and the number of lattice points on the z-axis is 8. In this case, the virtual 3D lookup table is assumed, in which one virtual lattice point is included in the x-axis (the number of lattice points is 8) and the y-axis (the number of lattice points is 6), a lattice is formed on the x and y-axes and the z-axis, and the virtual lattice points and the lattice points except for the virtual lattice points are provided. This virtual 3D lookup table has 384 (=8×6×8) lattice points including the virtual lattice points, and becomes completely equal to the normal 3D lookup table, in which odd-numbered lattice points are provided on the respective x, y, and z-axes (the number of lattice points on the x-axis is 8, the number of lattice points on the y-axis is 6, and the number of lattice points on the z-axis is 8), in the numbers of lattice points on the respective axes, the total number of lattice points, and the arrangement in the form of a lattice of the lattice points in up, down, left, and right directions. Accordingly, the data recording and reading in the virtual 3D lookup table, in which the respective x, y, and z-axes have even-numbered lattice points, can be performed in the same manner as in the normal 3D lookup table in which the numbers of lattice points on the x, y, and z-axis are not equal to those in the virtual 3D lookup table.

According to the data conversion apparatus having the above-described configuration, the same recording address operation can be performed with respect to the 3D lookup table that uses data conversion of data that belongs to the three-axis data space regardless of whether the numbers of lattice points on the respective axes are equal to each other and whether the number of lattice points on the axes that constitute the lookup table is an even number or an odd number. Also, the same reading address operation can also be performed with respect to the 3D lookup table in the same manner. That is, it is not required to perform a special recording address operation or a special reading address operation in the case where the number of lattice points is an odd number. As a result, the genericity of a 3D lookup table that is used to convert the converted data can be heightened. The completely same operation can be applied to the data conversion of the converted data that belongs to an m-axis (where, m is an integer that is equal to or larger than 2) data space in addition to the three-axis data space.

The data conversion apparatus as described above may have the following aspect. For example, the data conversion apparatus divides the assumed virtual 3D lookup table into unit 3D cubes so that the unit 3D cube, which includes two lattice points on x, y, and z-axes, respectively, and is composed of eight lattice points obtained from the respective lattice type axes in the up, down, left, and right directions, does not share the lattice points with the neighboring unit 3D cube; and in storing the correction data of the respective lattice points that include the virtual lattice points in the virtual 3D lookup table in the first to eighth memories through an address operation for recording data, the data conversion apparatus executes a memory allocation operation that considers one of the divided unit 3D cubes as a reference 3D cube and allocates the first to eighth memories to the first to eighth lattice points that are included in the reference 3D cube according to a memory allocation rule; and an address operation that stores the correction data at the first to eighth lattice points that are included in the reference 3D cube and at the first to eighth lattice points of the unit 3D cube except for the reference 3D cube that coincide with the first to eighth lattice points in the first to eighth memories allocated according to the memory allocation rule, as the address operation for recording the data, in the case where the unit 3D cube except for the reference 3D cube moves along the x, y, and z-axes and overlaps the reference 3D cube. The reference 3D cube and the unit 3D cube that overlaps the reference 3D cube are equal to each other in the position relationship between the x, y, and z-axes of the first to eighth lattice points included therein, and thus the same memory allocation rule that allocates the first to eighth memories to the first to eighth lattice points included in the reference 3D cube can be applied to the reference 3D cube and other unit 3D cubes.

In this case, for simplicity in configuration, the reference 3D cube may include the unit 3D cube that is composed of eight lattice points including a first lattice point that has minimum values of a value indicating the number of lattice points on the x-axis, a value indicating the number of lattice points on the y-axis, and a value indicating the number of lattice points on the z-axis, and seven lattice points that are positioned in the neighborhood of the first lattice point. For example, if it is assumed that the first lattice point is a lattice point having coordinates (0,0,0), the reference 3D cube is determined by the first lattice point and respective lattice points having coordinates (1,0,0), (1,1,0), (1,1,1), (1,0, 1), (0,0, 1), (0,1,0), and (0,1,1,), which are obtained by increasing each coordinate value by 1 along the x, y, and z-axes.

Also, the memory allocation rule may be a rule that determines the memory to be recorded among the first to eighth memories in accordance with a combination of an even number and an odd number of the value indicating the number of lattice points on the x-axis, the value indicating the number of lattice points on the y-axis, and the value indicating the number of lattice points on the z-axis. By doing this, the correction data at the lattice points can be easily stored in the first to eighth memories that correspond to the eight lattice points having the coordinates (0,0,0) to (0,1,1).

Application 2: Data Conversion Method

A data conversion method converting converted data that belongs to a three-axis data space, includes storing correction data at respective lattice points of a 3D lookup table, in which each of x, y, and z-axes that correspond to three axes is divided into two or more lattice points, and the correction data for correcting the converted data in correspondence to input values of the converted data are provided for the respective lattice points obtained from the respective lattice type axes, in a first to an eighth memory; and reading the correction data of the lattice points positioned around the converted data from the first to eighth memories with reference to the 3D lookup table, and converting the converted data based on the read correction data; wherein the storing of the correction data for the respective lattice points of the 3D lookup table in the first to eighth memories includes; assuming a virtual 3D lookup table, which has an axis in which one virtual lattice point is included on the side of an end portion of the axis, in which the number of the lattice points is an odd number, and the number of lattice points is an even number among the respective axes, a lattice type axis that is different from the axis that includes the virtual lattice points, and the virtual lattice points and lattice points except for the virtual lattice points, in the 3D lookup table in which any one of the x, y, and z-axes is an axis in which the number of lattice points is an odd number, and then allocating data to the virtual lattice points; and storing the data at the respective lattice points and the correction data at the lattice points except for the virtual lattice points in the virtual 3D lookup table in the first to eighth memories.

Even by the above-described data conversion method, using the 3D-LUT having high genericity, conversion of the converted data that belongs to the three-axis data space can be simply performed.

In addition, the present invention can be applied to data conversion for converting color space data to another color space data or data conversion that is performed in displaying images in an image display device such as a liquid crystal display panel or the like.

BRIEF DESCRIPTION OF THE DRAWINGS

The invention will be described with reference to the accompanying drawings, wherein like numbers reference like elements.

FIG. 7 is an explanatory diagram illustrating the relationship between the respective lattice points on the xy plane in the case of z=0 to 2 and correction data corresponding to the lattice points in an odd-numbered axis 3D-LUT.

FIG. 8 is an explanatory diagram illustrating the relationship between the respective lattice points on the xy plane in the case of z=3 to 5 and correction data corresponding to the lattice points in an odd-numbered axis 3D-LUT.

FIG. 9 is an explanatory diagram illustrating the relationship between the respective lattice points on the xy plane in the case of z=6 and 7 and correction data corresponding to the lattice points in an odd-numbered axis 3D-LUT.

FIG. 10 is a diagram corresponding to FIG. 7, and is an explanatory diagram illustrating the relationship between the respective lattice points on the xy plane in the case of z=0 to 2 and correction data corresponding to the lattice points in a virtual 3D-LUT.

FIG. 11 is a diagram corresponding to FIG. 8, and is an explanatory diagram illustrating the relationship between the respective lattice points on the xy plane in the case of z=3 to 5 and correction data corresponding to the lattice points in a virtual 3D-LUT.

FIG. 12 is a diagram corresponding to FIG. 9, and is an explanatory diagram illustrating the relationship between the respective lattice points on the xy plane in the case of z=6 and 7 and correction data corresponding to the lattice points in a virtual 3D-LUT.

FIG. 14 is an explanatory diagram illustrating a memory allocation rule that prescribes the relationship between the xyz coordinates of lattice points of a virtual 3D-LUT and memories.

FIG. 18 is an explanatory diagram of a correction data storing procedure in a virtual 3D-LUT in relation to respective lattice points of the xy plane in the case of z=0 to 2 in the virtual 3D-LUT.

FIG. 19 is an explanatory diagram of a correction data storing procedure in relation to respective lattice points of the xy plane in the case of z=3 to 5 in a virtual 3D-LUT.

FIG. 20 is an explanatory diagram of a correction data storing procedure in relation to respective lattice points of the xy plane in the case of z=6 and 7 in a virtual 3D-LUT.

FIGS. 23A and 23B are explanatory diagrams of a correction data storing procedure in a virtual 3D-LUT in relation to respective lattice points of (0,4,0) to (7,5,0) of the xy plane in the case of z=0 in the virtual 3D-LUT.

FIGS. 24A and 24B are explanatory diagrams of a correction data storing procedure in a virtual 3D-LUT in relation to respective lattice points of (0,0,1) to (7,1,1) of the xy plane in the case of z=1 in the virtual 3D-LUT.

FIGS. 25A and 25B are explanatory diagrams of a correction data storing procedure in a virtual 3D-LUT in relation to respective lattice points of (0,2,1) to (7,3,1) of the xy plane in the case of z=1 in the virtual 3D-LUT.

FIGS. 26A and 26B are explanatory diagrams of a correction data storing procedure in a virtual 3D-LUT in relation to respective lattice points of (0,4,1) to (7,5,1) of the xy plane in the case of z=1 in the virtual 3D-LUT.

FIGS. 27A to 27C are explanatory diagrams illustrating the storing result corresponding to respective lattice points of (0,0,2) to (7,5,7) of the xy plane in the case of z=2 to 7 in a virtual 3D-LUT in a correction data storing procedure in the virtual 3D-LUT.

FIGS. 29A to 29D are diagrams corresponding to FIGS. 27A to 27C, and are explanatory diagrams illustrating the storing results corresponding to the respective lattice points in a modified example in which virtual lattice points VK in a virtual 3D-LUT correspond to correction data at lattice points in the neighborhood of the virtual lattice points.

DESCRIPTION OF EXEMPLARY EMBODIMENTS

Hereinafter, embodiments of the invention will be described based on examples in which the invention is applied to a projector in the following order.

A. Configuration of a projector

B. Configuration of an image processing circuit

C. 3D-LUT data recording process

A. Configuration of a Projector

Figure 1:
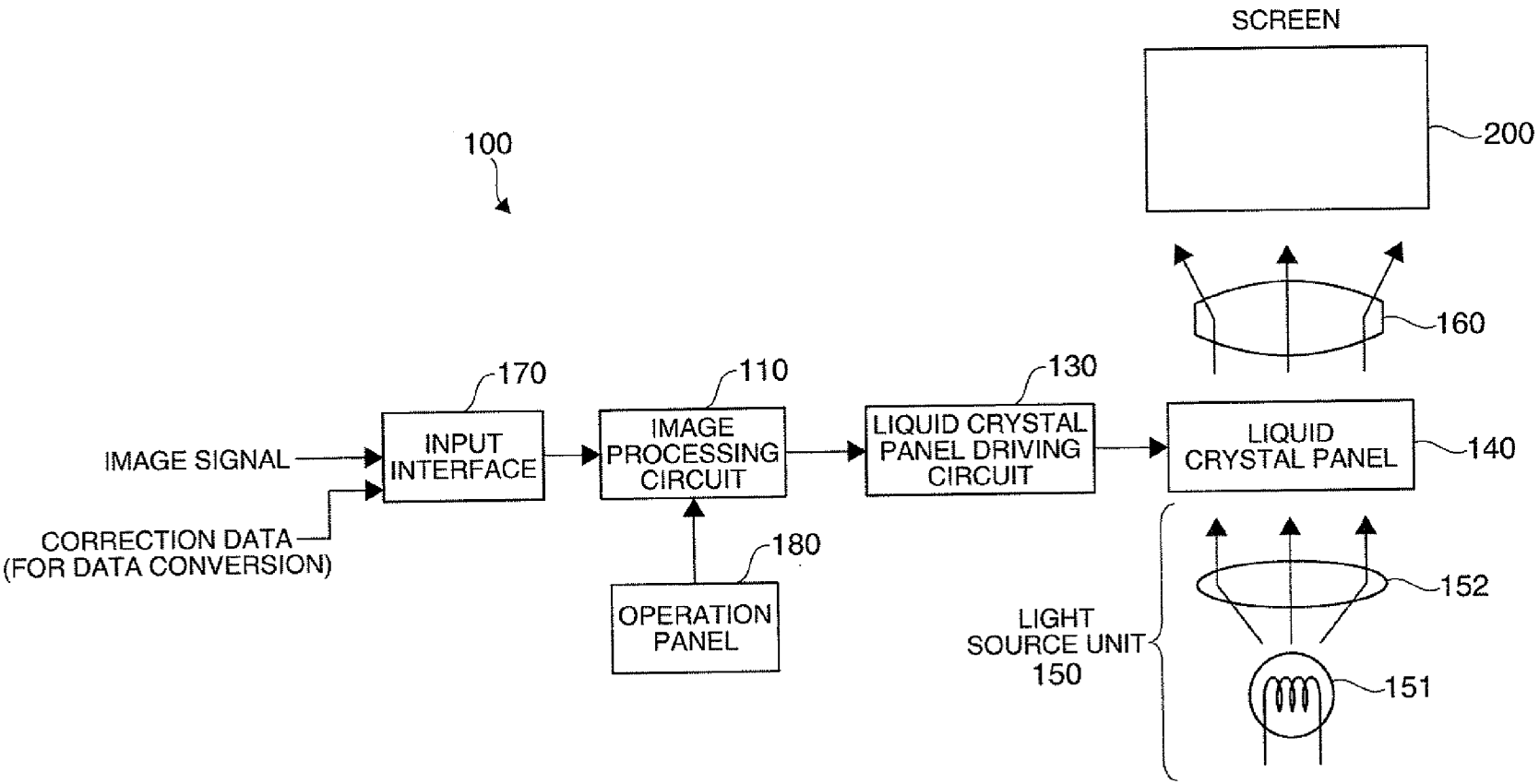
FIG. 1 is an explanatory diagram illustrating the schematic configuration of a projector according to an embodiment of the invention.

FIG. 1 is an explanatory diagram illustrating the schematic configuration of a projector 100 according to an embodiment of the invention. As illustrated, the projector 100 according to this embodiment includes an input interface 170, an image processing circuit 110, a liquid crystal panel driving circuit 130, a liquid crystal panel 140, a light source unit 150, a projection lens 160, and an operation panel 180.

The input interface 170 is connected to an image output device that outputs an image signal and a correction output device that outputs correction data for constructing a 3D lookup table (hereinafter referred to as a "3D-LUT"). The input interface 170 includes a circuit that A/D-converts an analog image signal input from the image output device and generates a digital signal having 8-bit R (Red), G (Green), and B (Blue) colors, that is, data of 256 stages. Examples of image output devices connected to the input interface 170 may be a DVD player, a video deck, and a personal computer. The correction output device is an output device of correction data, which corrects (correction-converts) image data that is output corresponding to respective pixels in image display in the liquid crystal panel 140. The input interface 170, which has received the correction data, outputs the corresponding data to the image processing circuit 110.

The image processing circuit 110 inputs the image data signal (digital signal) output from the input interface 170, and converts the image data signal into data that corresponds to image display in the liquid crystal panel 140. Specifically, the image processing circuit 110 converts the tone of color that corresponds to the input image data into that appropriate to the image display in the liquid crystal panel 140 by correcting the image data signal to corrected data that corresponds to lattice points in a 3D-LUT to be described later.

The operation panel 180 is provided with various kinds of operation buttons operated by a user or a device adjustment operator, and outputs control signals according to the respective operation buttons to the image processing circuit 110.

The liquid crystal panel driving circuit 130 inputs the image data after the data correction, which is output from the image processing circuit 110, and outputs the input image data to the liquid crystal panel 140 to display the image on the liquid crystal panel 140.

The liquid crystal panel 140 is a transmission type write bulb which is controlled by the liquid crystal panel driving circuit 130, and forms an image using a liquid crystal device. The liquid crystal panel 140 modulates light incident from the light source unit 150, and outputs the modulated light to the side of a screen 200.

The light source unit 150 is a light source that emits light to the liquid crystal panel 140. The light source unit 150 includes a lamp 151 that generates light and a lens 152 that outputs the light generated from the lamp to the liquid crystal panel.

The projection lens 160 is a lens that enlarges and projects the modulated light output from the liquid crystal panel 140 toward the screen 200.

In the projector 100 as configured above, an image composed of image data input by the input interface 170 is corrected by the image processing circuit 110 and is projected onto the screen 200.

B. Configuration of an Image Processing Circuit

Figure 2:
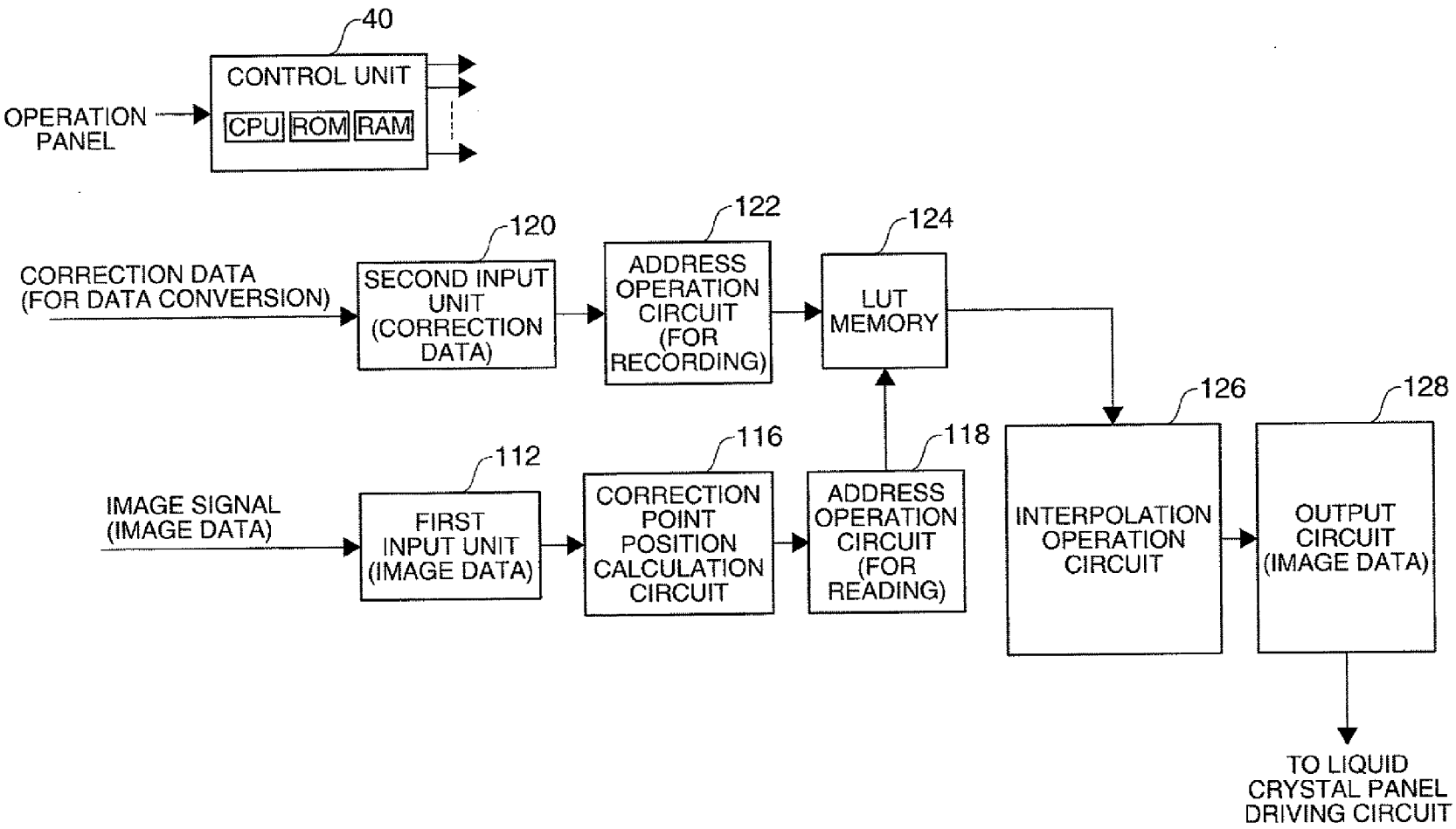
FIG. 2 is a block diagram illustrating the detailed configuration of an image processing circuit.

FIG. 2 is a block diagram illustrating the detailed configuration of the image processing circuit 110. As illustrated, the image processing circuit 110 receives two-channel data, and in order to process the data, includes a first input unit 112, a correction point position calculation circuit 116, an address operation circuit 118, another second input unit 120, an address operation circuit 122, an LUT memory 124, an interpolation operation circuit 126, an output circuit 128, and a control unit 40. These circuits configure the data storage unit and the data conversion unit independently or in cooperation.

The control unit 40 is a unit that performs the whole control of the projector 100. The control unit 40 includes a CPU, a ROM, and a RAM. The CPU loads a control program stored in the ROM onto the RAM to execute the control program, and performs diverse control operations of the projector 100 by outputting control signals to the above-described circuits.

In the ROM, 3D-LUT data to be described later is stored in a non-volatile manner, and the control unit 40 reads the 3D-LUT data from the ROM, and records the read data in the LUT memory 124. The recorded 3D-LUT becomes the 3D-LUT for reference for correcting (reference-correcting) the image data output to the liquid crystal panel 140 (see FIG. 1) to be described later. This reference 3D-LUT (a virtual 3D-LUT to be described later) is prepared through an address operation for recording at the timing of correction data input to the second input unit 120 in an adjustment process before shipment in the latter half of a manufacturing process of the projector 100 or correction data input (re-input) to the second input unit 120 at a data resetting time when the correction of the corrected data is required in the use process of the projector 100, and is recorded in the LUT memory 124 and the ROM.

In the image data input system, the correction point position calculation circuit 116 calculates the position of the correction point (specifically, the position of a lattice point of the 3D-LUT) that is used to correct the image data input through the first input unit 112 of the image data system. The address operation circuit 118 operates a read address that corresponds to the position of the correction point. In the correction data input system, the address operation circuit 122 operates the address of the lattice point that is the subject of recording the correction data input through the second input unit 120. The LUT memory 124 is a memory device that can update and record the data, and stores and maintains in a non-volatile manner the 3D-LUT for correcting the data reference after updating the position of the lattice point that is the subject of updating the correction data. Accordingly, the projector 100 is used to correct the image data through the 3D-LUT for correcting the data reference after the updating. The interpolation operation circuit 126 performs an interpolation operation of the image data using the correction data at the respective lattice points with reference to the correction data at the lattice points of the 3D-LUT corresponding to the image data, and outputs the image data after correction to the liquid crystal panel 140, specifically, to the liquid crystal panel driving circuit 130, through the output circuit 128. Since the data correction operation with reference to the correction data at the lattice points in the 3D-LUT is not different from the existing process, and is not directly related to the subject matter of the present invention, the detailed description thereof will be omitted.

C. 3D-LUT Data Recording Process

Figure 3:
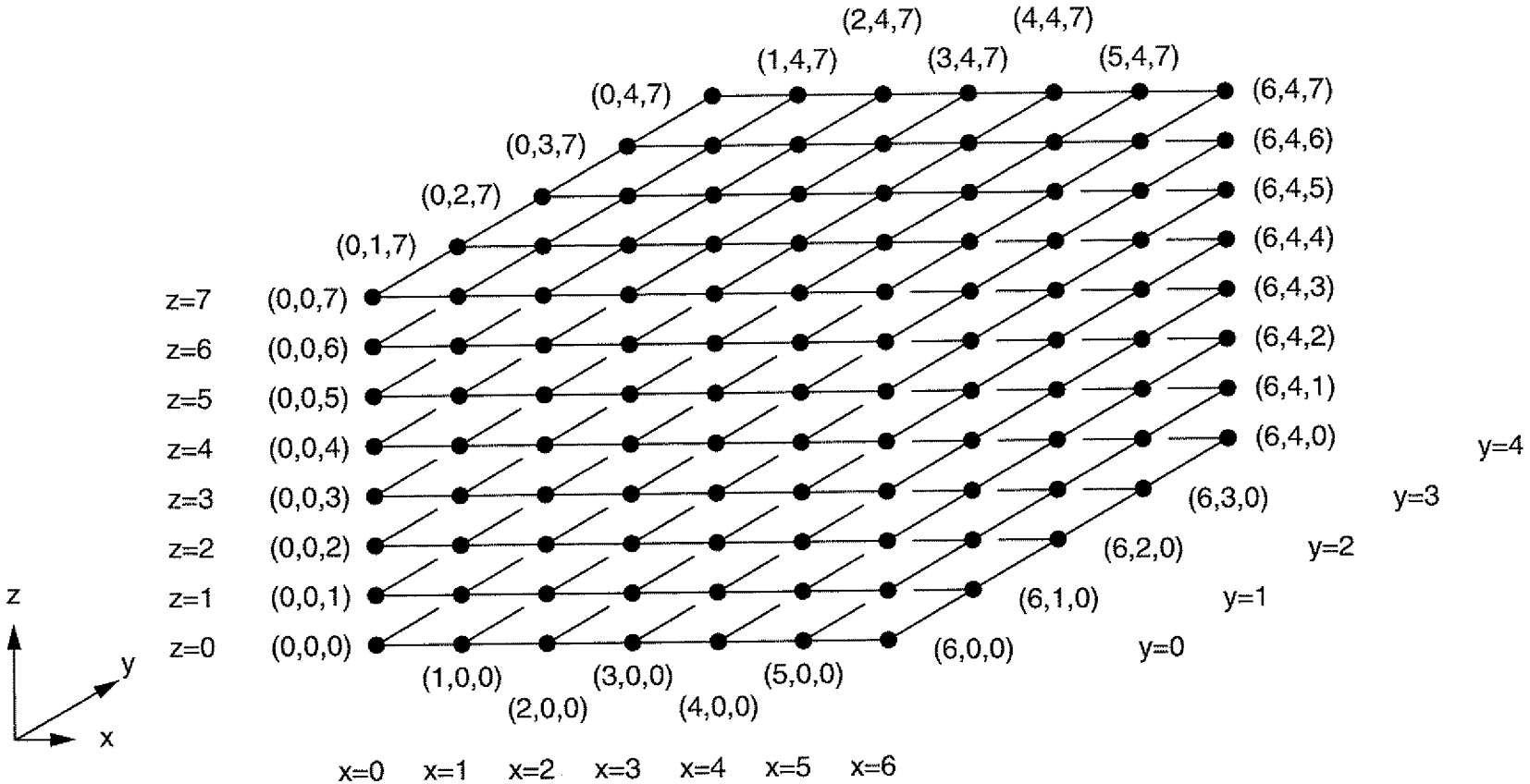
FIG. 3 is an explanatory diagram conceptually illustrating a 3D-LUT in which data for correcting image data is provided at every lattice point.
Figure 4:
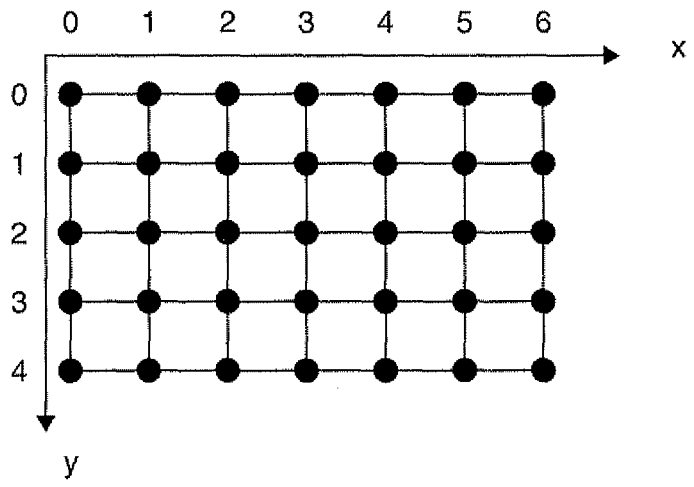
FIG. 4 is an explanatory diagram illustrating the shape of lattice points when a 3D-LUT is seen from the xy plane.
Figure 5:
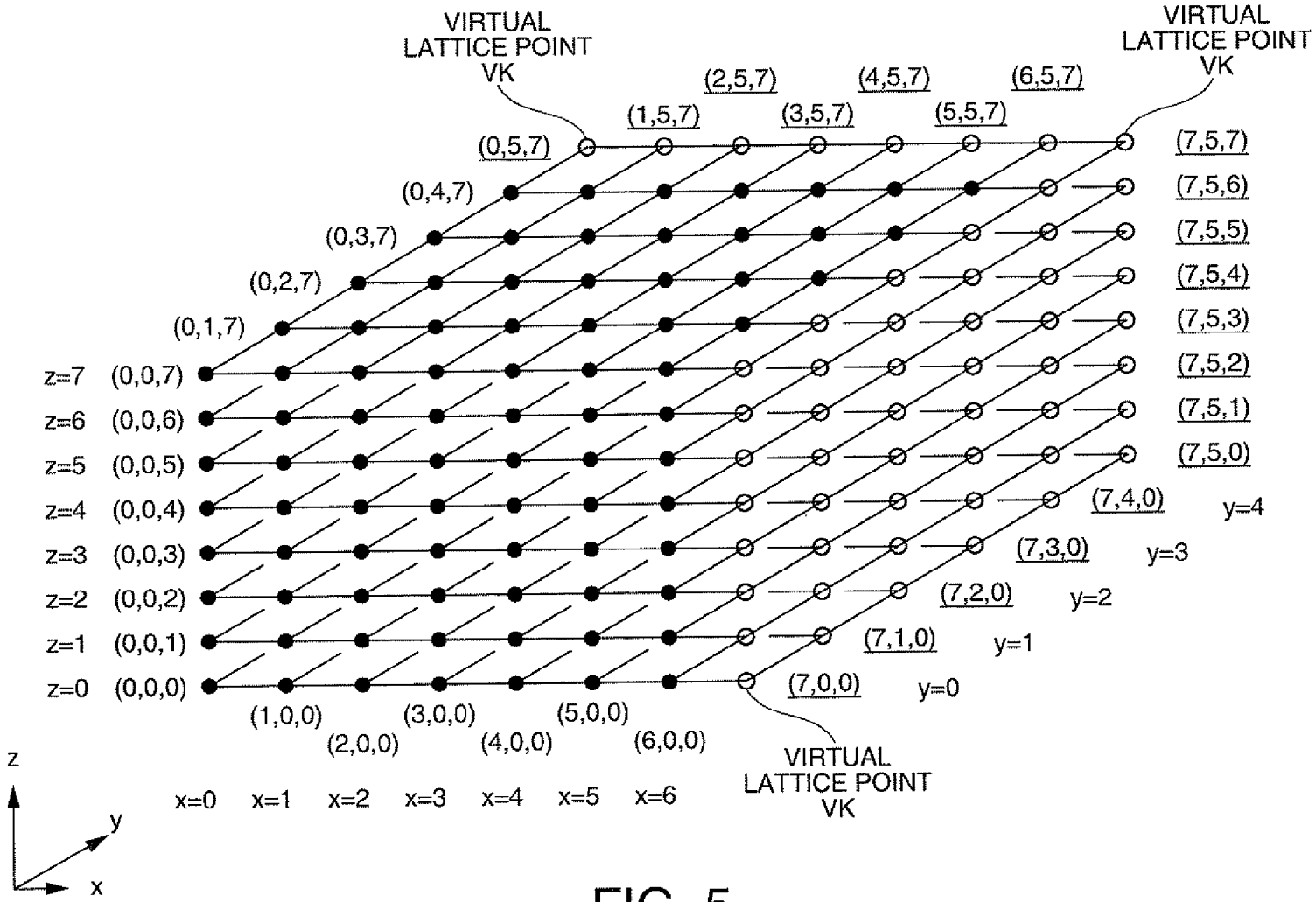
FIG. 5 is an explanatory diagram conceptually illustrating a virtual 3D-LUT including virtual lattice points that have no correction data.
Figure 6:
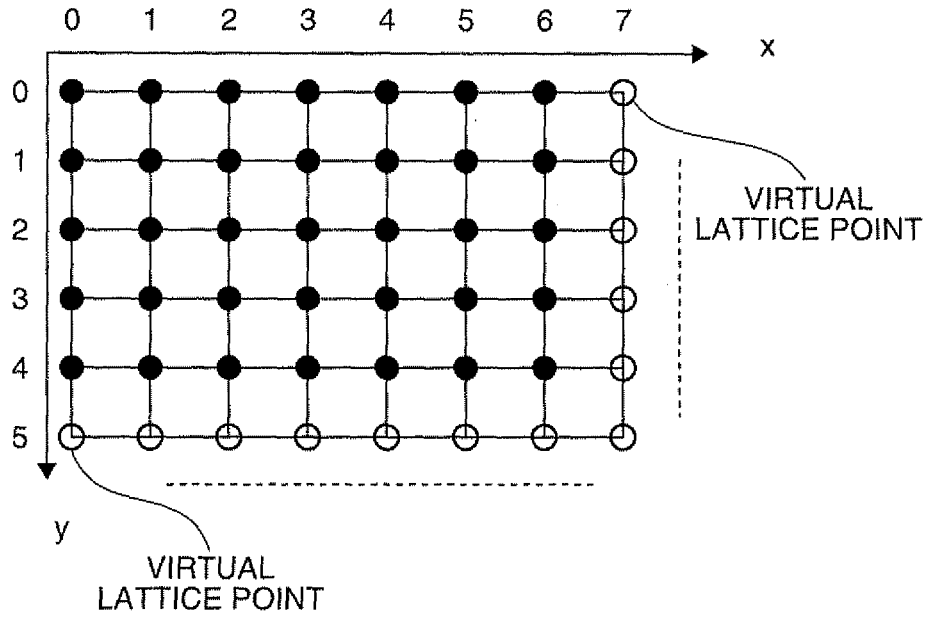
FIG. 6 is a diagram corresponding to FIG. 4, and is an explanatory diagram illustrating the shape of lattice points when a virtual 3D-LUT is seen from the xy plane.

FIG. 3 is an explanatory diagram conceptually illustrating a 3D-LUT in which data for correcting image data is provided at every lattice point, FIG. 4 is an explanatory diagram illustrating the shape of lattice points when a 3D-LUT is seen from the xy plane, and FIG. 5 is an explanatory diagram conceptually illustrating a virtual 3D-LUT including virtual lattice points that have no correction data. FIG. 6 is a diagram corresponding to FIG. 4, and is an explanatory diagram illustrating the shape of lattice points when a virtual 3D-LUT is seen from the xy plane.

In the project 100 according to this embodiment, the 3D-LUT that is used to correct the image data during the image display, as illustrated in FIG. 3, is a lookup table in which an x-axis having seven lattice points of 0 to 6, a y-axis having five lattice points of 0 to 4, and a z-axis having eight lattice points of 0 to 7 are in the form of a lattice on up, down, left, and right directions, and each lattice point has correction data. That is, since the 3D-LUT of FIG. 3 includes odd-numbered lattice points on the x-axis and the y-axis, it becomes an odd-numbered axis 3D-LUT. In this odd-numbered axis 3D-LUT, the xy plane, as illustrated in FIG. 4, has lattice points which constitute a lattice on the x-axis and the y-axis and correspond to left and right pixel arrangements that constitute a display screen of the liquid crystal panel 140, and the respective lattice points have correction data that correspond to pixel positions on the display screen. In the odd-numbered axis 3D-LUT, xy planes overlap in multi-stages, the overlapping direction is considered on the z-axis which corresponds to the correction data in the gray scale direction, and the respective lattice points of the 3D-LUT have the correction data that correspond to the pixel positions and gray scale expression. Since the xy plane as shown in FIG. 4 corresponds to the pixel arrangement of the liquid crystal panel 140, the image data input from an external video device to the first input unit 112 becomes data on the outline of the xy plane or data included in the xy plane. Also, as regards the gray scale of the corresponding image data, as illustrated in FIG. 3, the corresponding image data becomes data that is included in the range of 0 to 7 in the z-axis direction.

In this embodiment, with respect to the odd-numbered axis 3D-LUT as described above, a virtual 3D lookup table (virtual 3D-LUT) is assumed, in which one virtual lattice point is added to the end portion of the x-axis having seven lattice points of 0 to 6 to make the x-axis have eight (even-numbered) lattice points, one virtual lattice point VK is added to the end portion of the y-axis having five lattice points of 0 to 4 to make the y-axis have six (even-numbered) lattice points, the x-axis and y-axis including the virtual lattice points VK and the z-axis having eight lattice points of 0 to 7 form a lattice in up, down, left, and right directions, and thus the virtual lattice point VK and the lattice points except for the virtual lattice points VK are provided. This virtual 3D-LUT, as illustrated in FIGS. 5 and 6, becomes the 3D lookup table in which virtual lattice points VK are added to the odd-numbered axis 3D-LUT as illustrated in FIGS. 3 and 4.

FIG. 7 is an explanatory diagram illustrating the relationship between the respective lattice points on the xy plane in the case of z=0 to 2 and correction data corresponding to the lattice points in an odd-numbered axis 3D-LUT, FIG. 8 is an explanatory diagram illustrating the relationship between the respective lattice points on the xy plane in the case of z=3 to 5 and correction data corresponding to the lattice points in an odd-numbered axis 3D-LUT, and FIG. 9 is an explanatory diagram illustrating the relationship between the respective lattice points on the xy plane in the case of z=6 and 7 and correction data corresponding to the lattice points in an odd-numbered axis 3D-LUT. FIG. 10 is a diagram corresponding to FIG. 7, and is an explanatory diagram illustrating the relationship between the respective lattice points on the xy plane in the case of z=0 to 2 and correction data corresponding to the lattice points in a virtual 3D-LUT. FIG. 11 is a diagram corresponding to FIG. 8, and is an explanatory diagram illustrating the relationship between the respective lattice points on the xy plane in the case of z=3 to 5 and correction data corresponding to the lattice points in a virtual 3D-LUT. FIG. 12 is a diagram corresponding to FIG. 9, and is an explanatory diagram illustrating the relationship between the respective lattice points on the xy plane in the case of z=6 and 7 and correction data corresponding to the lattice points in a virtual 3D-LUT.

As illustrated in FIGS. 7 to 9, in the odd-numbered axis 3D-LUT, correction data of D000 to D034 correspond to the lattice points included on the xy plane in the case of z=0, that is, the lattice points of (0,0,0) to (6,4,0) that are indicated by xyz coordinate values, and correction data of D035 to D279 correspond to the lattice points in the case of z=1 to 7 in the same manner. On the other hand, as illustrated in FIGS. 10 to 12, in the virtual 3D-LUT, on the xy plane in the case of z=0 to 7, in the same manner as in FIGS. 7 to 9, correction data of D001 to D279 correspond to the lattice points except for the virtual lattice points VK, and non-data or recording unnecessary data corresponds to the virtual lattice points VK as the data that indicates there is no correction data. In FIGS. 3 and 6, the xyz coordinates that indicate the virtual lattice points VK are underlined, and by this underline, it is indicated that the non-data or recording unnecessary data corresponds to the virtual lattice points VK. In FIGS. 10 to 12, the virtual lattice points VK are marked as "pad", and by this mark, it is indicated the non-data or recording unnecessary data corresponds to the virtual lattice points VK.

The illustrated virtual 3D-LUT, although it includes the virtual lattice points VK, is in the form of a lattice in up, down, left, and right directions on the x-axis having eight lattice points of 0 to 7, the y-axis having six lattice points of 0 to 5, and the z-axis having eight lattice points of 0 to 7. Comparing this virtual 3D-LUT including the virtual lattice points with a 3D lookup table (hereinafter referred to as a "normal 3D-LUT") in which the numbers of lattice points on the respective axes are all even numbers (eight lattice points of 0 to 7 on the x-axis, six lattice points of 0 to 5 on the y-axis, and eight lattice points of 0 to 7 on the z-axis), the virtual 3D-LUT and the normal 3D-LUT completely become equal to each other in the number of lattice points on the respective axes, the total number (8×6×8=384) of lattice points, and the arrangement in up, down, left, and right directions of the lattice points. Further, since the virtual 3D-LUT has the correction data at the lattice points that are not the virtual lattice points VK, and even the virtual lattice points VK correspond to non-data or recording unnecessary data, the virtual 3D-LUT becomes equal to the normal 3D-LUT even on the point that the data is provided at the entire respective lattice points although the data property or the data generation technique of the virtual 3D-LUT is different from that of the normal 3D-LUT.

Figure 13:
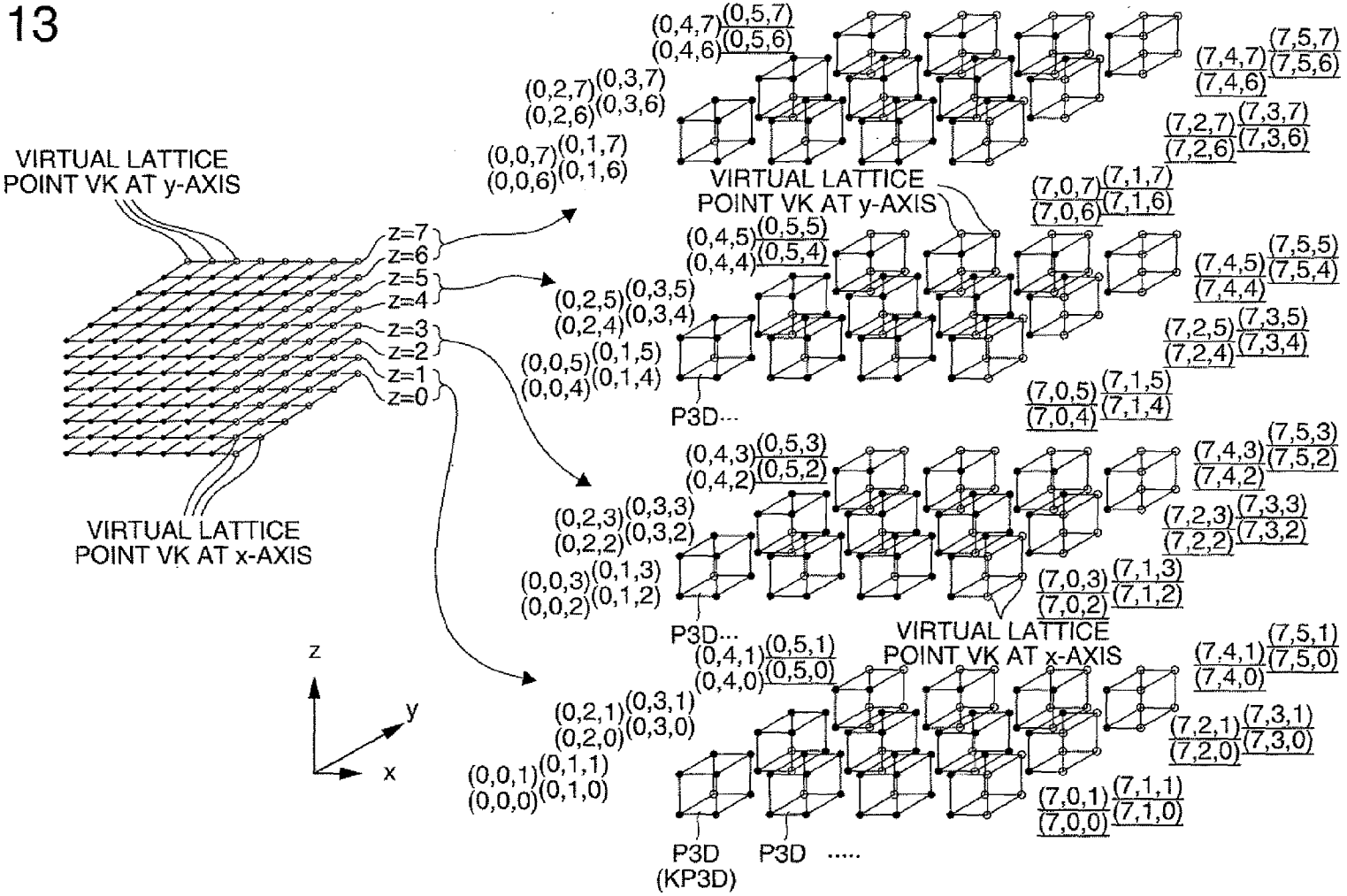
FIG. 13 is an explanatory diagram conceptually illustrating a memory allocation rule when correction data at lattice points of a virtual 3D-LUT are allocated to memories.
Figure 15:
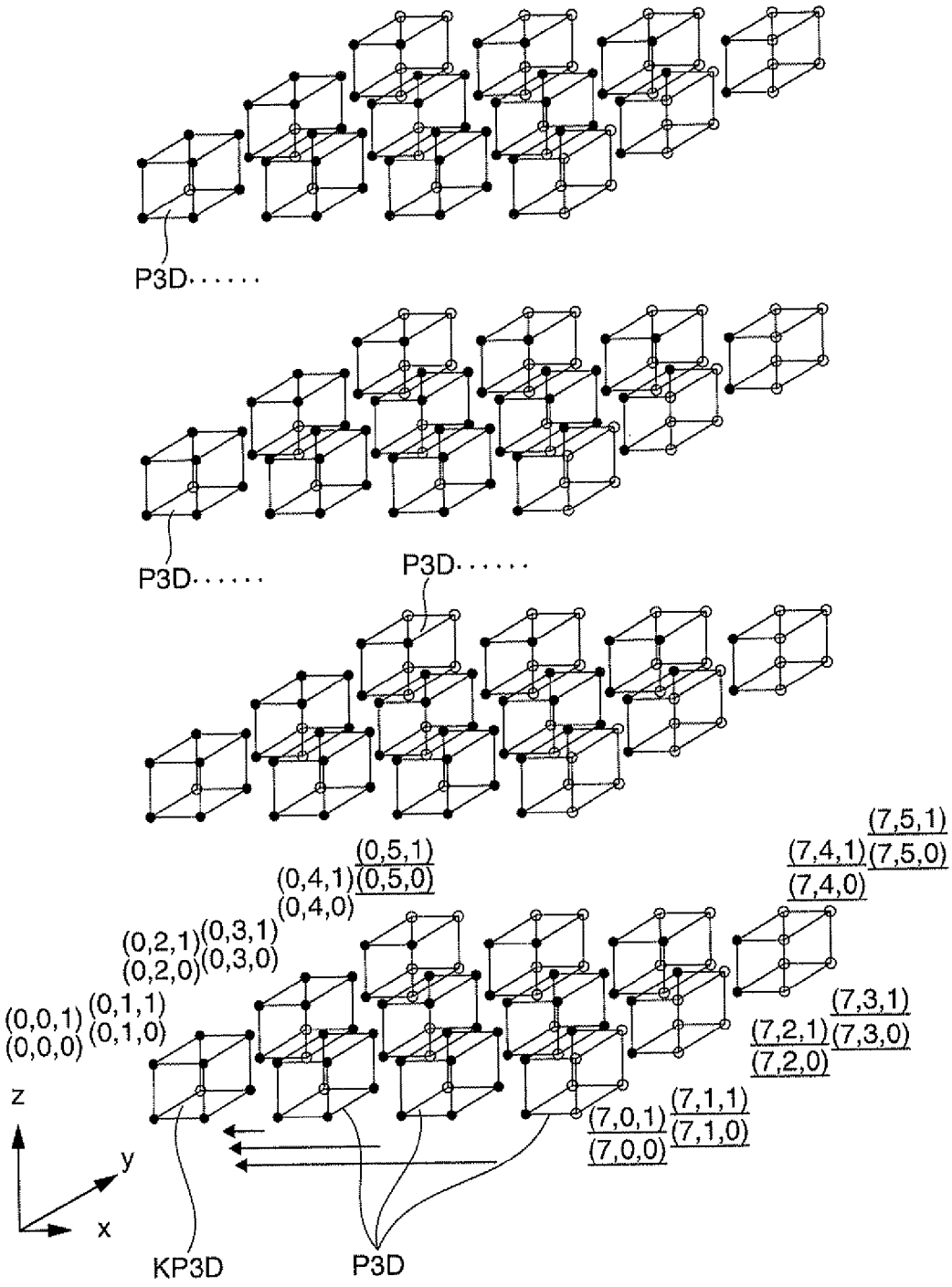
FIG. 15 is an explanatory diagram conceptually illustrating a procedure of a memory allocation rule.
Figure 16:
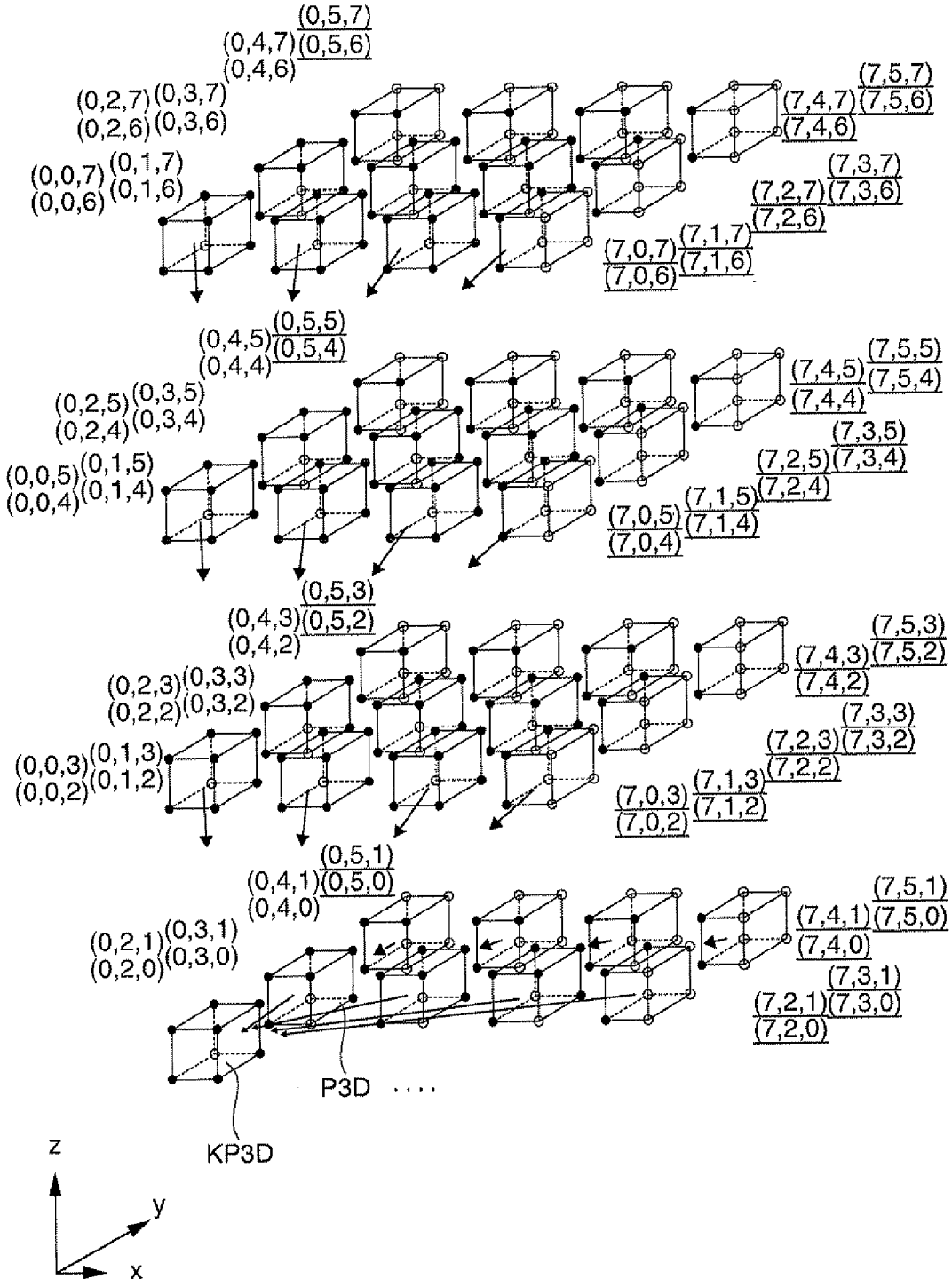
FIG. 16 is an explanatory diagram conceptually illustrating a procedure of a memory allocation rule that follows FIG. 15.
Figure 17:
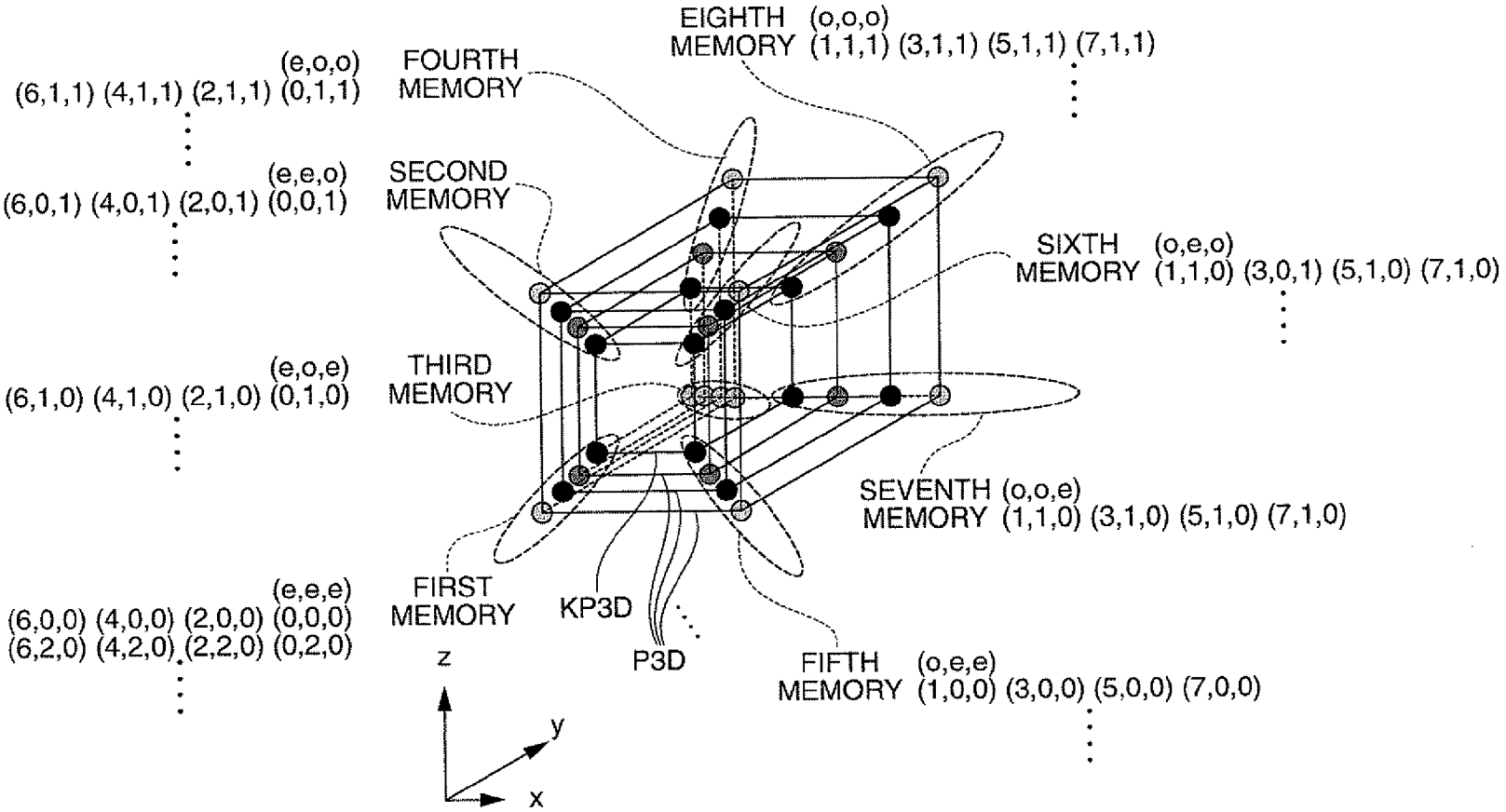
FIG. 17 is an explanatory diagram conceptually illustrating the shape of memory storage allocated according to a memory allocation rule.

Using the common table construction as described above, in this embodiment, the correction data is stored in the memories as follows. FIG. 13 is an explanatory diagram conceptually illustrating a memory allocation rule when correction data at lattice points of a virtual 3D-LUT are allocated to memories, and FIG. 14 is an explanatory diagram illustrating a memory allocation rule that prescribes the relationship between the xyz coordinates of lattice points of a virtual 3D-LUT and memories. FIG. 15 is an explanatory diagram conceptually illustrating a procedure of a memory allocation rule, and FIG. 16 is an explanatory diagram conceptually illustrating a procedure of a memory allocation rule that follows FIG. 15. FIG. 17 is an explanatory diagram conceptually illustrating the shape of memory storage allocated according to a memory allocation rule.

As illustrated in FIG. 13, in the virtual 3D-LUT, the xy planes that overlap in the z-axis direction have pairs of 0 and 1, 2 and 3, 4 and 5, and 6 and 7 as z-axis coordinates of the lattice points, and the virtual 3D-LUT is divided into unit 3D cubes P3D so that the unit 3D cube, which includes two lattice points on x and y-axes, respectively, and is composed of eight lattice points obtained from the respective lattice type axes, does not share the lattice points with the neighboring unit 3D cube. Among the divided unit 3D cubes P3D, a unit 3D cube P3D that includes the lattice points indicated by coordinates of (0,0,0) among the coordinate minimum values on the respective x, y, and z-axes is considered as a reference unit 3D cube KP3D.

Then, a memory allocation rule for allocating the first to eighth memory is applied to eight first to eighth lattice points included in the reference unit 3D cube KP3D. This memory allocation rule prescribes an operation rule of an address operation for recording the correction data. In this embodiment, as illustrated in FIG. 14, a rule for determining a memory to be recorded among the first to eight memories in accordance with a combination of an even number and an odd number of an x-axis coordinate value, a y-axis coordinate value, and z-axis coordinate value in inscribing the xyz coordinates of the first to eighth lattice points is adopted as the memory allocation rule, so that the first memory is allocated with a first lattice point at which the respective axis coordinate values are all even numbers, the second memory is allocated with a second lattice point at which the xy-axis coordinate value is an even number and the z-axis coordinate value is an odd number, the third memory is allocated with a third lattice point at which the xz-axis coordinate value is an even number and the y-axis coordinate value is an odd number, the fourth memory is allocated with a fourth lattice point at which the x-axis coordinate value is an even number and the yz-axis coordinate value is an odd number, the fifth memory is allocated with a fifth lattice point at which the x-axis coordinate value is an odd number and the yz-axis coordinate value is an even number, the sixth memory is allocated with a sixth lattice point at which the xz-axis coordinate value is an odd number and the y-axis coordinate value is an even number, the seventh memory is allocated with a seventh lattice point at which the xy-axis coordinate value is an odd number and the z-axis coordinate value is an even number, and the eighth memory is allocated with an eighth lattice point at which the xyz-axis coordinate values are all odd numbers. In this embodiment, although the above-described memory allocation rule is adopted, other allocation rules may be adopted since the eight lattice points included in the reference unit 3D cube KP3D can correspond to the eight first to eighth memories in a one-to-one manner.

With respect to the remaining unit 3D cubes P3D except for the reference unit 3D cube KP3D, in the case where the unit 3D cubes P3D are moved to overlap the reference unit 3D cube KP3D as illustrated in FIGS. 15 and 16, and the correction data at the first to eighth lattice points that are included in the reference unit 3D cube KP3D and at the first to eighth lattice points of the remaining unit 3D cubes P3D that coincide with the first to eighth lattice points are allocated according to the above-described memory allocation rule. That is, the remaining unit 3D cubes P3D that stand in the x-axis direction of the reference unit 3D cube KP3D are moved to overlap the reference unit 3D cube KP3D (see FIG. 15), and then the remaining unit 3D cubes P3D that are apart for one cube in the y-axis direction of the reference unit 3D cube KP3D are moved to overlap the reference unit 3D cube KP3D in the order of their standing in the x-axis direction (see FIG. 16), and the above-described process is repeated with respect to the lowermost remaining unit 3D cubes P3D in FIG. 16. Thereafter, the remaining unit 3D cubes P3D that are apart for one cube in the z-axis direction sequentially overlap the reference unit 3D cube KP3D. The shape of the above-described lattice overlapping is illustrated in FIG. 17.

Here, the relationship among the first to eighth lattice points in the unit 3D cubes P3D including the reference unit 3D cube KP3D will be described. In the case of converting the image data which is the subject of data conversion and has passed through correction for the correction data, it is discriminated which unit 3D cube P3D of the virtual 3D-LUT the corresponding image data is included in or whether the corresponding data is positioned between the unit 3D cubes P3D that stand in up, down, left, and right directions. In this discrimination, the lattice points in the neighborhood of the lattice point to be converted are determined through comparison of the xyz coordinate values of the lattice point to be converted that correspond to the image data with the coordinate values of the respective lattice points of the unit 3D cubes P3D that occupy the virtual 3D-LUT. First, a case where the image data that is the subject of data conversion is included in the unit 3D cube P3D of the virtual 3D-LUT will be described. In this case, it is discriminated which unit 3D cube P3D included in the virtual 3D-LUT the unit 3D cube P3D included inside the lattice point to be converted is through comparison of the coordinates of the lattice points of the unit 3D cube P3D included in the virtual 3D-LUT with the coordinates of conversion symmetric points. Accordingly, the first to eighth lattice points included in the unit 3D cube P3D that are discriminated to include the point to be converted are determined. The correction data that corresponds to the first to eighth lattice points of the unit 3D cube P3D is stored in a determined address through an address operation to be described later, and respective addresses of the eight correction data that correspond to the first to eight lattice points has regularity that is determined in the operation rule of the address operation. Accordingly, by obtaining one lattice point of the unit 3D cube P3D that includes the point to be converted inside the cube from the any one unit 3D cube P3D included in the virtual 3D-LUT, the eight correction data that correspond to the eight lattice points (that is, first to eight lattice points of the unit 3D cube P3D) in the neighborhood of the point to be converted can be simply read from the memories based on the regularity determined in the address operation rule.

In the case where the point to be converted that corresponds to the image data is positioned between the unit 3D cubes P3D that stand in the up, down, right, and left directions, four lattice points, which are included in two unit 3D cubes P3D having opposite surfaces of the cube between which the point to be converted is inserted and are positioned on the sides of the point to be converted, or two lattice points, which are included in four unit 3D cubes P3D that face each other on the ridge in the z-axis direction of the cubes between which the point to be converted is inserted and are positioned on the sides of the point to be converted are obtained. The correction data on the four lattice points included in the two unit 3D cubes P3D having opposite surfaces between which the point to be converted is inserted, or on the two lattice points, which are included in four unit 3D cubes P3D that face each other on the ridge in the z-axis direction of the cubes, are stored in predetermined addresses through the address operation to be described later. Accordingly, the respective addresses of eight correction data that correspond to the eight lattice points have the regularity determined in the operation rule of the address operation, and thus the correction data can be simply read based on the corresponding regularity.

In this embodiment, the storing procedure of the correction data at the respective lattice points of the virtual 3D-LUT that prescribes the operation rule of the address operation for recording the correction data is as follows. FIG. 18 is an explanatory diagram of a correction data storing procedure in a virtual 3D-LUT in relation to respective lattice points of the xy plane in the case of z=0 to 2 in the virtual 3D-LUT, FIG. 19 is an explanatory diagram of a correction data storing procedure in relation to respective lattice points of the xy plane in the case of z=3 to 5 in a virtual 3D-LUT, and FIG. 20 is an explanatory diagram of a correction data storing procedure in relation to respective lattice points of the xy plane in the case of z=6 and 7 in a virtual 3D-LUT. As illustrated, in the case of z=0 to z=7, the correction data is stored in the order of the small xy-coordinate values. The correction data storing procedure coincides with the input order of the correction data (correction data for converting the data) to the second input unit 120.

Figure 21A:
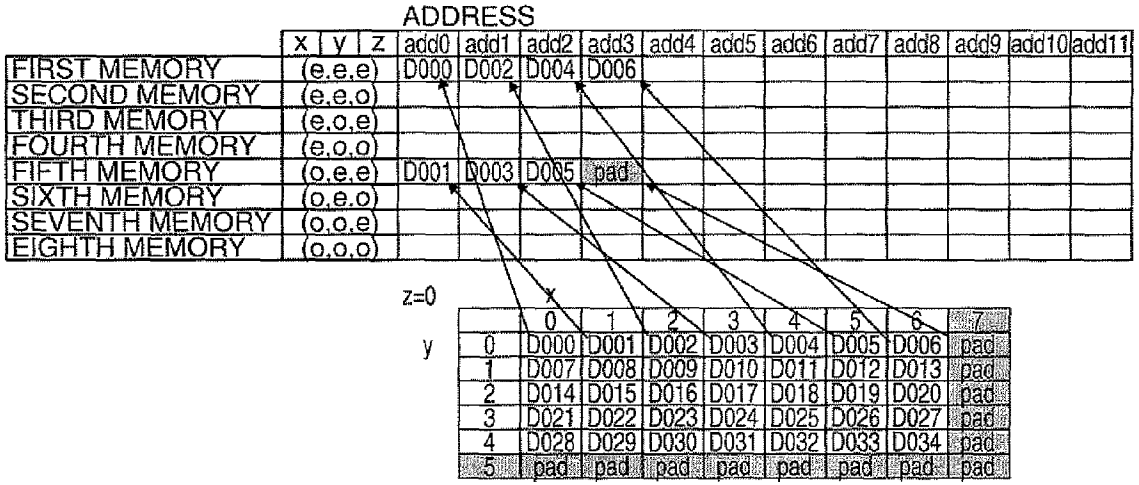
FIGS. 21A and 21B are explanatory diagrams of a correction data storing procedure in a virtual 3D-LUT in relation to respective lattice points of (0,0,0) to (7,1,0) of the xy plane in the case of z=0 in the virtual 3D-LUT.
Figure 21B:
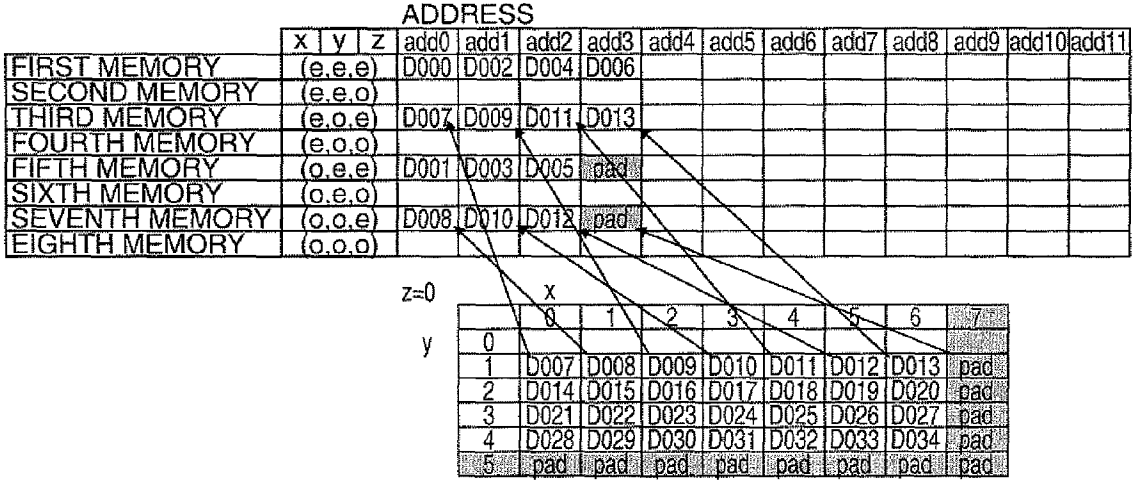
Figure 22A:
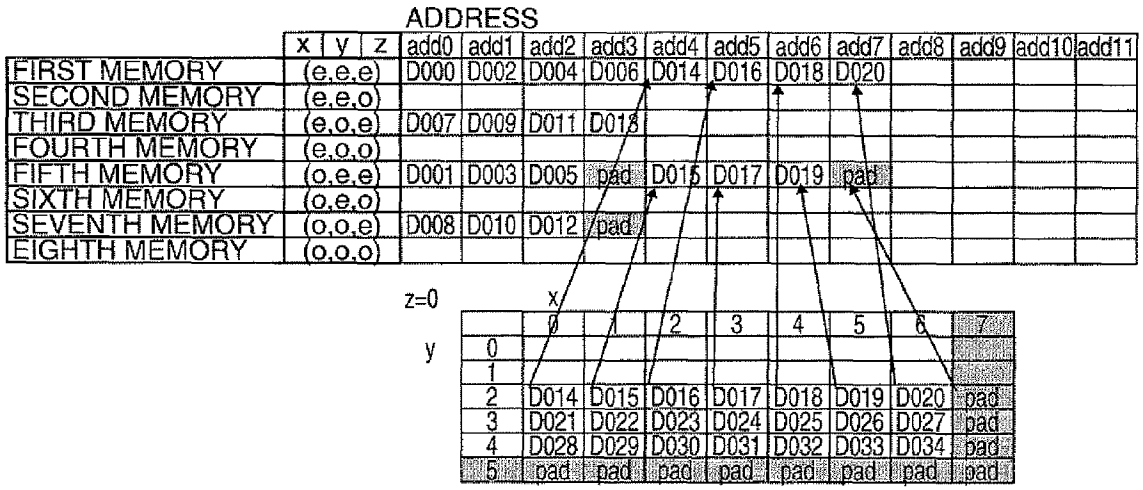
FIGS. 22A and 22B are explanatory diagrams of a correction data storing procedure in a virtual 3D-LUT in relation to respective lattice points of (0,2,0) to (7,3,0) of the xy plane in the case of z=0 in the virtual 3D-LUT.
Figure 22B:
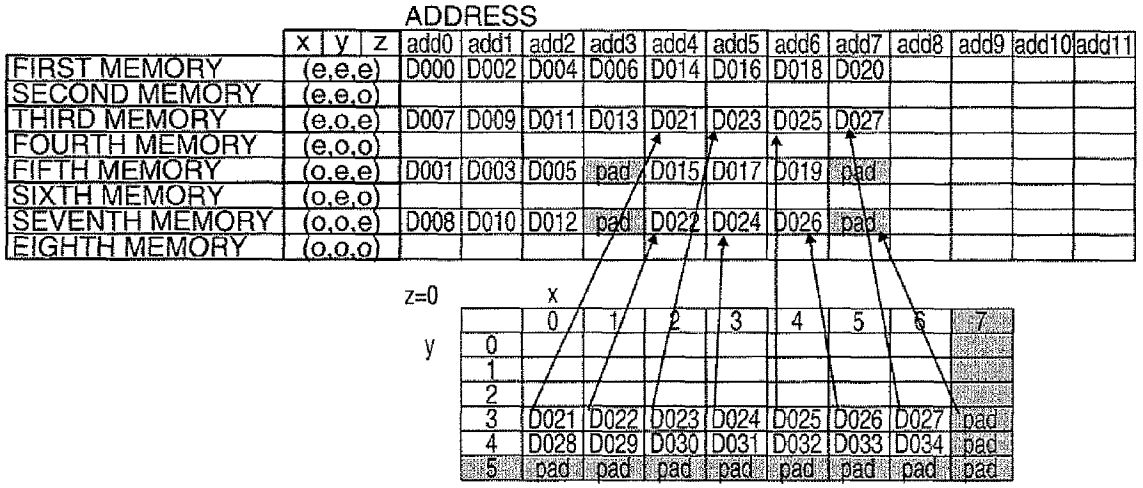

FIGS. 21A and 21B are explanatory diagrams of a correction data storing procedure in a virtual 3D-LUT in relation to respective lattice points of (0,0,0) to (7,1,0) of the xy plane in the case of z=0 in the virtual 3D-LUT, FIGS. 22A and 22B are explanatory diagrams of a correction data storing procedure in a virtual 3D-LUT in relation to respective lattice points of (0,2,0) to (7,3,0) of the xy plane in the case of z=0 in the virtual 3D-LUT, and FIGS. 23A and 23B are explanatory diagrams of a correction data storing procedure in a virtual 3D-LUT in relation to respective lattice points of (0,4,0) to (7,5,0) of the xy plane in the case of z=0 in the virtual 3D-LUT. FIGS. 24A and 24B are explanatory diagrams of a correction data storing procedure in a virtual 3D-LUT in relation to respective lattice points of (0,0,1) to (7,1,1) of the xy plane in the case of z=1 in the virtual 3D-LUT, FIGS. 25A and 25B are explanatory diagrams of a correction data storing procedure in a virtual 3D-LUT in relation to respective lattice points of (0,2,1) to (7,3,1) of the xy plane in the case of z=1 in the virtual 3D-LUT, FIGS. 26A and 26B are explanatory diagrams of a correction data storing procedure in a virtual 3D-LUT in relation to respective lattice points of (0,4,1) to (7,5,1) of the xy plane in the case of z=1 in the virtual 3D-LUT, and FIGS. 27A to 27C are explanatory diagrams illustrating the storing result corresponding to respective lattice points of (0,0,2) to (7,5,7) of the xy plane in the case of z=2 to 7 in a virtual 3D-LUT in a correction data storing procedure in the virtual 3D-LUT. In this embodiment, since data storing, which corresponds to the total number (8×6×8.384) of lattice points including the virtual lattice points VK of the virtual 3D-LUT, in the first to eighth memories is necessary, the first to eighth memories have memory capacity which can be designated by addresses of 0 to 47, and the respective addresses of the entire addresses (8×48=384) of the first to eighth memories correspond to the respective lattice points of the total number (8×6×8=384) of the lattice points including the virtual lattice points VK.

As illustrated in FIGS. 21A to 27C, in the virtual 3D-LUT, the correction data at the respective lattice points of (0,0,0) to (7,5,7) of the xy plane in the case of z=0 to 7 are stored in the ascending order from the address of the small address number of each memory to be allocated after passing through the discrimination of the first to eighth memories sequentially allocated starting from the lattice point of (0,0,0). In storing the address numbers in the ascending order, the operation rule of the address operation for recording the correction data is prescribed. In this case, in the memory addresses that correspond to the virtual lattice points VK ((7,0,0) to (7,4,0) and (0,5,0,) to (7,5,7)), "pad" that indicates the non-data or recording unnecessary data is stored. That is, in the case of storing the correction data at the respective lattice points in the reference 3D-LUT composed of x, y, and z-axes having the same numbers of lattice points (8 on the x-axis, 6 on the y-axis, and 8 on the z-axis) as those in the virtual 3D-LUT, the correction data are sequentially stored with respect to the respective lattice points that correspond to the virtual lattice points VK in the virtual 3D-LUT as illustrated in FIGS. 21A to 27C. Also, in the case of storing the data at the lattice points in the virtual 3D-LUT, the data are sequentially stored in the respective addresses of the memories to be allocated in the order of small address values in the same procedure as the reference 3D-LUT. On the other hand, as is clear from FIG. 26B illustrating the storing result of the data in the case of z=0 to 1 and FIGS. 27A to 27C illustrating the storing result of the data in the case of z=2 to 7, in the respective memories of the first to eighth memories, as illustrated in FIGS. 15 to 17, correction data at the first to eighth lattice points included in the reference unit 3D cube KP3D and at the first to eighth lattice points of the remaining unit 3D cubes P3D that coincide with the first to eighth lattice points are allocated.

Figure 28:
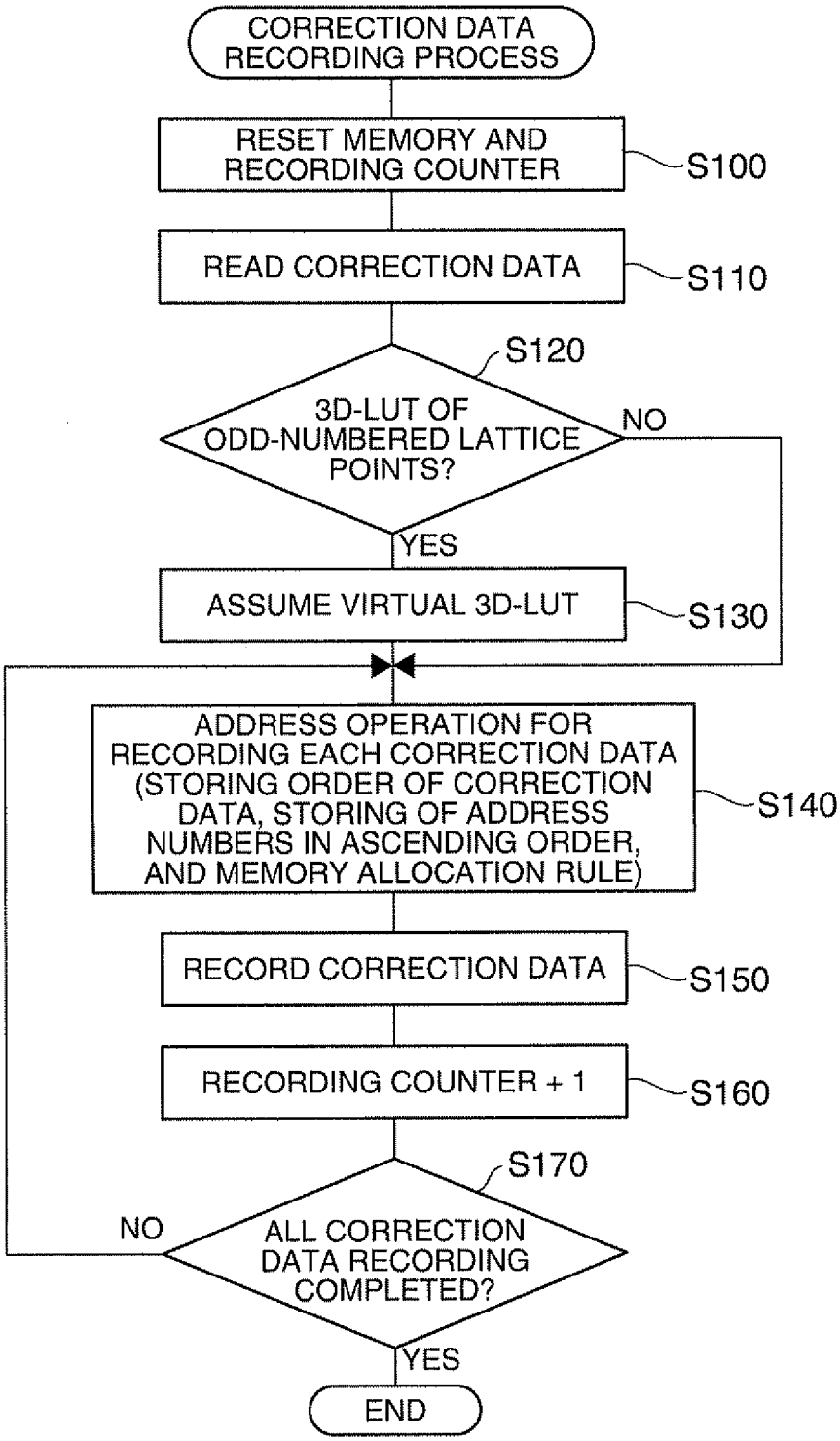
FIG. 28 is a flowchart illustrating a correction data recording process.

Next, the correction data recording process as described above will be described. FIG. 28 is a flowchart illustrating a correction data recording process. In this embodiment, the correction data processing as illustrated in FIG. 28 is executed whenever a button for setting the correction data or a dip switch in the operation panel 180 is operated in the manufacturing process (adjustment process) of the projector 100 or at the correction data resetting time as described above. First, in step S100, the memory contents of the LUT memory 124 is reset and a recording counter is reset based on a control signal from the control unit 40.

Then, in step S110, the correction data input from the second input unit 120 are read. The read correction data are generated by a correction data generation device, separately from the projector 100, and are correction data at the respective lattice points in a typical 3D-LUTU that includes no virtual lattice point VK (see FIGS. 3 to 4). In this case, the read correction data may be any one of correction data in the normal 3D-LUTU having even-numbered lattice points on the respective x, y, and z-axes in the 3D-LUT and correction data in the odd-numbered axis 3D-LUT including the odd-numbered lattice points on the x, y, and z-axes.

In step S120, it is determined whether the read correction data are correction data in the odd-numbered axis 3D-LUT including the odd-numbered lattice points. This determination is made based on the number of read correction data and the number of lattice points on the x, y, and z-axes of the 3D-LUT. Here, if the read correction data are those in the normal 3D-LUTU, it is not necessary to assume the virtual 3D-LUT, and thus the processing proceeds to step S140. On the other hand, if the read correction data are those in the odd-numbered axis 3D-LUTU, as described above, the virtual 3D-LUT in which the virtual lattice points VK are added to the odd-numbered axis is assumed (step S130). That is, if the read correction data are those in the odd-numbered axis 3D-LUT in which the x and y-axes as illustrated in FIGS. 3 and 4 are odd-numbered axes, the virtual 3D-LUT as illustrated in FIGS. 5 and 6, in which the x and y-axes and the z-axis are even-numbered axes that are in the form of a lattice in up, down, left, and right directions, is assumed by adding the virtual lattice points VK to the x and y-axes, and the virtual lattice points VK correspond to non-data or recording unnecessary data (pad) as described above.

In step S140 that follows the step S130, an address operation for recording the data is performed for each correction data (in the initial step S140, correction data on the coordinates of (0,0,0)) at the lattice points corresponding to a recording counter (in the initial step S140, zero). In the address operation, the correction data storing procedure as described above, storing of the address numbers in the ascending order in the first to eighth memories, and an address operation for recording the data in accordance with the operation rule prescribed in the memory allocation rule of the first to eighth memories corresponding to the combination of an even number and an odd number of the values of the respective axes in the x, y, and z coordinate prescription are performed. Specifically, in the case of the correction data on the coordinates of (0,0,0) that is the subject of the initial recording operation, as illustrated in FIGS. 21A and 21B, the address operation is performed so that the correction data D000 is recorded in the address of add0 of the first memory. If the correction data that is the subject of recording operation is changed, the address operation of the changed correction data is performed. The address operation for recording the data in step S140 is performed for the respective correction data at the lattice points included in the normal 3D-LUTU if it is determined that the read correction data are those in the normal 3D-LUTU in step S120.

To follow the address operation for recording the data in step S140, the corresponding correction data are recorded in the corresponding addresses of the first to eighth memories in accordance with the addresses of the operation result (step S150), and in order to perform the address operation and recording of the continuing correction data, the recording counter counts up only by 1 (step S160). Then, it is determined whether the recording of the correction data at all lattice points is completed from the recording count-up value, that is, whether the recording of the correction data at all lattice points including the virtual lattice points VK in the case of the virtual 3D-LUT or the recording to the correction data at the lattice points included in the normal 3D-LUT in the case of the normal 3D-LUTU is completed (step S170), and the processing from the step S140 continues until a positive determination is made.

In the projector 100 according to this embodiment as described above, in the case of the 3D-LUT which has lattice points corresponding to input correction data and in which any one of the x, y, and z-axes has the odd-numbered lattice points in recording the input correction data in the first to eighth memories to correspond to the lattice points in the 3D-LUT, the virtual 3D-LUT which has the axis having even-numbered lattice points is assumed by adding the virtual lattice points VK to the end portion of the odd-numbered axis. In this embodiment, since both x and y-axes have odd-numbered lattice points in the 3D-LUT (see FIGS. 3 and 4) having the lattice points corresponding to the input correction data, the x and y-axes are made to x and y-axes having even-numbered lattice points, and then the virtual 3D-LUT is assumed, which has the virtual lattice points VK and the lattice points except for the virtual lattice points VK, in the form of a lattice in up, down, left, and right directions on the x and y-axes and the z-axis having the even-numbered lattice points (see FIGS. 5 and 6 and steps S120 to S130 in FIG. 28). Then, the input correction data correspond to the lattice points except for the virtual lattice points VK, "pad" that indicates non-data or recording unnecessary data corresponds to the virtual lattice points VK, and the input correction data and the "pad" as the data are recorded on the corresponding addresses of the first to eighth memories through an address operation for reading the data (see FIGS. 21A to 27C and steps S140 to 150 in FIG. 28). Accordingly, in handling the virtual 3D-LUT as the subject of address operation for recording the data, the virtual 3D-LUT becomes completely equal to the normal 3D-LUTU in which the numbers of lattice points on the respective axes are all even numbers and are equal to the numbers of lattice points in the virtual 3D-LUT and correction data correspond to the respective lattice points (in this embodiment, the 3D-LUT having eight lattice points on the x-axis, six lattice points on the y-axis, and eight lattice points on the z-axis) in the number of lattice points on the respective axes, the total number of lattice points, and the lattice arrangement of the lattice points.

Further, as illustrated in FIGS. 10 to 12, in the virtual 3D-LUT, correction data D000 to D279 are provided at the lattice points that are not the virtual lattice points VK, and "pad" as the data is provided at the virtual lattice points VK. Accordingly, the virtual 3D-LUT becomes equal to the normal 3D-LUT on the point that the respective lattice points are provided with data, even though the data properties or the data generation techniques of the virtual 3D-LUT and the normal 3D-LUT are different from each other. Because of this, the address operation for recording the data for storing the correction data for the respective lattice points in the first to eighth memories (in this embodiment, the correction data storing order, storing of the address numbers in the ascending order in the first to eighth memories, and an address operation for recording the data in accordance with the operation rule prescribed in the memory allocation rule of the first to eighth memories corresponding to the combination of an even number and an odd number of the values of the respective axes in the x, y, and z coordinate prescription) is equal to the storing of the correction data at the respective lattice points in the normal 3D-LUT becomes equal to the storing of the correction data at the respective lattice points including the virtual lattice points VK in the virtual 3D-LUT.

Further, since the normal 3D-LUT and the virtual 3D-LUT are equal to each other on the point of the number of lattice points and the arrangement of the lattice points and on the point that the respective lattice points are provided with data, the same address operation for reading the data for reading the correction data at eight lattice points positioned in the neighborhood of the point to be converted that correspond to the image data input to the first input unit 112 from the first to eighth memories can be applied to the case where the correction data is read from the lattice points of the normal 3D-LUT and to the case where the correction data is read from the lattice points of the virtual 3D-LUT. As a result, according to the projector 100 in this embodiment, in converting the image data that belongs to the three-axis data space using the correction data that corresponds to the lattice points of the 3D-LUT, the same recording address operation can be performed regardless of whether the numbers of lattice points on the respective axes in the 3D-LUT that is composed of the lattice points corresponding to the correction data are equal to each other and whether the number of lattice points on the axes that constitute the 3D-LUT is an even number or an odd number. Also, the same reading address operation can be performed. That is, it is not required to perform a special recording address operation or a special reading address operation in the case where the number of lattice points is an odd number. Because of this, according to the projector 100 in this embodiment, the genericity of the 3D-LUT that is used to convert the image data can be heightened.

Also, the data conversion apparatus according to the present invention has the following advantages. In the case where the correction data is given as the odd-numbered axis 3D-LUT having the lattice points as illustrated in FIGS. 3 and 4, the lattice points corresponding to the correction data are not determined as the virtual lattice points VK in the virtual 3D-LUT, but become the lattice points except for the virtual lattice points VK in the virtual 3D-LUT. On the other hand, in converting the input image data, the correction data corresponding to the lattice points in the neighborhood of the input image data to be converted is used, and thus the input image data to be converted is not positioned outside the outermost lattice points in the odd-numbered axis 3D-LUT. Because of this, in the address operation for reading the data to convert the input image data, the lattice points that are outside the outermost lattice points in the odd-numbered axis 3D-LUT, that is, the virtual lattice points VK in the virtual 3D-LUT, cannot become the subject of the address operation for reading the data. Accordingly, in reading the data from the lattice points of the virtual 3D-LUT, which have passed through the address operation for reading the data, the virtual lattice points VK do not take part in the address operation, and thus if the data in the virtual 3D-LUT is read in the same address operation for reading the data, the reading of the correction data in the odd-numbered axis 3D-LUT, which become the basis for assuming the virtual 3D-LUT, can be performed with no harm.

Also, in the projector 100 in this embodiment, the virtual 3D-LUT is divided into unit 3D cubes P3D so that the unit 3D cube P3D, which includes two lattice points on x, y, and z-axes, respectively, and is composed of eight lattice points in the up, down, left, and right directions, does not share the lattice points with the neighboring unit 3D cubes P3D. Also, in storing the correction data of the respective lattice points that include the virtual lattice points VK in the virtual 3D-LUT in the first to eighth memories through an address operation for recording data, the projector executes a memory allocation operation that considers the one divided unit 3D cube P3D as a reference 3D cube KP3D and allocates the first to eighth memories to the first to eighth lattice points that are included in the reference 3D cube KP3D according to a memory allocation rule, and an address operation that stores the correction data at the first to eighth lattice points that are included in the reference 3D cube KP3D and at the first to eighth lattice points of the unit 3D cube P3D except for the reference 3D cube KP3D that coincide with the first to eighth lattice points in the first to eighth memories allocated according to the memory allocation rule, as the address operation for recording the data, in the case where the unit 3D cube P3D except for the reference 3D cube KP3D moves along the x, y, and z-axes and overlaps the reference 3D cube KP3D. The reference 3D cube KP3D and the unit 3D cube P3D that overlaps the reference 3D cube KP3D are equal to each other in the position relationship between the x, y, and z-axes of the first to eighth lattice points included therein, and thus the same memory allocation rule that allocates the first to eighth memories to the first to eighth lattice points included in the reference 3D cube KP3D can be applied to the reference 3D cube KP3D and other unit 3D cubes P3D to cause convenience. Also, in this embodiment, if it is assumed that the first lattice point is a lattice point having coordinates (0,0,0), the reference 3D cube KP3D is determined by the first lattice point and respective lattice points having coordinates (1,0,0), (1,1,0), (1,1,1), (1,0,1), (0,0,1), (0,1,0), and (0,1,1,), which are obtained by increasing each coordinate value by 1 along the x, y, and z-axes to cause further convenience.

Although an embodiment of the invention has been described, the present invention is not limited to the embodiment as described above, and diverse modifications may be made within the scope that does not secede from the scope of the invention. For example, in the above-described embodiment, although it is exemplified that the 3D-LUT (see FIGS. 3 and 4) provided with the lattice points corresponding to the input correction data has odd-numbered lattice points on both x and y-axes, the virtual 3D-LUT can be assumed by adding one virtual lattice point to the axes on which the odd-numbered lattice points are provided even in the case where one of the x, y, and z-axes has odd-numbered lattice points and in the case where the respective x, y, and z-axes have odd-numbered lattice points, respectively.

Also, in the above-described embodiment, although the "pad" that indicates the non-data or the recording unnecessary data corresponds to the virtual lattice points VK, it may be modified so that the correction data at the lattice points in the neighborhood of the virtual lattice points VK correspond to the virtual lattice points VK. FIGS. 29A to 29D are diagrams corresponding to FIGS. 27A to 27C, and are explanatory diagrams illustrating respective lattice points in a modified example in which virtual lattice points VK in a virtual 3D-LUT correspond to correction data at lattice points in the neighborhood of the virtual lattice points. This modified example has the following advantages.

It is assumed that the input image data input to the first input unit 112 are positioned outside the outermost lattice points in the odd-numbered axis 3D-LUT as illustrated in FIG. 3. In this case, in converting the input image data, the virtual lattice points VK and the correction data at the lattice points in the neighborhood of the virtual lattice point VK are read through the address operation for reading the data. Since the data that correspond to the read virtual lattice points VK are equal to the correction data at the lattice points in the neighborhood of the corresponding virtual lattice points VK, big data conversion error does not occur in the results of converting the input image data using the correction data at the read virtual lattice points VK. Accordingly, a sense of incongruity in the display image based on the image data after data conversion can be reduced.

In addition, in the above-described embodiment, although a projector is exemplified for the 3D-LUT that is used to convert the image which belongs to a three-axis data space that corresponds to the xy arrangement of pixels in left and right directions and the gray scale expression in the liquid crystal panel 140, the application of the invention is not limited thereto, and the present invention can be applied to a high-vision type liquid crystal TV, a plasma display, and the like. In addition, the present invention can be applied to the conversion of data in the color space that is represented by three data axes of RGB into data in another color space that corresponds to ink colors of a printing device. Further, in the above-described embodiment, although the data conversion of image data that belongs to the three-axis data space has been described, the present invention can also be applied to data conversion of converted data that belongs to a two-axis data space or data conversion of converted data that belongs to four or more-axis data space.

The entire disclosure of Japanese Patent Application No. 2010-054078, filed Mar. 11, 2010 is expressly incorporated by reference herein.

What is claimed is:

1. A data conversion apparatus for converting converted data that belongs to an m-axis, where m is an integer that is equal to or larger than 2, data space, comprising:

a data storage unit that stores correction data at respective lattice points of an m-dimensional lookup table, in which each of the m axes is divided into two or more lattice points, and the correction data for correcting the converted data in correspondence to input values of the converted data is provided for the respective lattice points obtained from the respective lattice type axes, in a first to an N-th (where, N is $2^m$) memories; and a data conversion unit that reads the correction data at the lattice points positioned around the converted data from the first to N-th memories with reference to the m-dimensional lookup table, and converts the converted data based on the read correction data, wherein the data storage unit assumes a virtual m-dimensional lookup table, which has an axis in which one virtual lattice point is included on the side of an end portion of the axis, in which the correction data is prepared and the number of the lattice points is an odd number, and the number of lattice points is an even number among the respective axes, a lattice type axis that is different from the axis that includes the virtual lattice points, and the virtual lattice points and lattice points except for the virtual lattice points, and then allocates data also to the virtual lattice points, and the data storage unit stores the data at the respective virtual lattice points and the correction data at the lattice points except for the virtual lattice points in the virtual m-dimensional lookup table in the first to N-th memories.

2. The data conversion apparatus according to claim 1, wherein the m-dimensional lookup table is a 3D lookup table in which x, y, and z-axes that correspond to three axes are in the form of a lattice in order to convert the converted data that belongs to a three-axis data space; and the data storage unit assumes a virtual 3D lookup table, which has an axis in which one virtual lattice point is included on the side of an end portion of the axis, in which the correction data is prepared and the number of the lattice points is an odd number, and the number of lattice points is an even number among the respective x, y, and z-axes in the 3D lookup table, a lattice type axis that is different from the axis that includes the virtual lattice points, and the virtual lattice points and lattice points except for the virtual lattice points, and then allocates data also to the virtual lattice points, and the data storage unit stores data at the respective virtual lattice points and the correction data at the lattice points except for the virtual lattice points in the virtual 3D lookup table in the first to eighth memories.

3. The data conversion apparatus according to claim 2, wherein the data allocated to the virtual lattice points is data that indicates there is no correction data or the correction data for the lattice points except for the virtual lattice points that are adjacent to the virtual lattice points.

4. The data conversion apparatus according to claim 2, wherein the data storage unit divides the assumed virtual 3D lookup table into unit 3D cubes so that the unit 3D cube, which includes two lattice points on x, y, and z-axes, respectively, and is composed of eight lattice points obtained from the respective lattice type axes, does not share the lattice points with the neighboring unit 3D cube, and in storing the correction data of the respective lattice points that include the virtual lattice points in the virtual 3D lookup table in the first to eighth memories through an address operation for recording data, the data storing unit executes a memory allocation operation that considers the one divided unit 3D cube as a reference 3D cube and allocates the first to eighth memories to the first to eighth lattice points that are included in the reference 3D cube according to a memory allocation rule; and an address operation that stores the correction data at the first to eighth lattice points that are included in the reference 3D cube and at the first to eighth lattice points of the unit 3D cube except for the reference 3D cube that coincide with the first to eighth lattice points in the first to eighth memories allocated according to the memory allocation rule, as the address operation for recording the data, in the case where the unit 3D cube except for the reference 3D cube moves along the x, y, and z-axes and overlaps the reference 3D cube.

5. The data conversion apparatus according to claim 4, wherein the reference 3D cube includes the unit 3D cube that is composed of eight lattice points including a first lattice point that has minimum values of a value indicating the number of lattice points on the x-axis, a value indicating the number of lattice points on the y-axis, and a value indicating the number of lattice points on the z-axis, and seven lattice points that are positioned in the neighborhood of the first lattice point.

6. The data conversion apparatus according to claim 5, wherein the memory allocation rule is a rule that determines the memory to be recorded among the first to eighth memories in accordance with a combination of an even number and an odd number of the value indicating the number of lattice points on the x-axis, the value indicating the number of lattice points on the y-axis, and the value indicating the number of lattice points on the z-axis.

7. A data conversion method for converting converted data that belongs to a three-axis data space, comprising:

storing correction data at respective lattice points of a 3D lookup table, in which each of x, y, and z-axes that correspond to three axes is divided into two or more lattice points, and the correction data for correcting the converted data in correspondence to input values of the converted data is provided for the respective lattice points obtained from the respective lattice type axes, in a first to an eighth memory; and reading the correction data of the lattice points positioned around the converted data from the first to eighth memories with reference to the 3D lookup table, and converting the converted data based on the read correction data;

wherein the storing of the correction data for the respective lattice points of the 3D lookup table in the first to eighth memories includes assuming a virtual 3D lookup table, which has an axis in which one virtual lattice point is included on the side of an end portion of the axis, in which the number of the lattice points is an odd number, and the number of lattice points is an even number among the respective axes, a lattice type axis that is different from the axis that includes the virtual lattice points, and the virtual lattice points and lattice points except for the virtual lattice points, in the 3D lookup table in which any one of the x, y, and z-axes is an axis in which the number of lattice points is an odd number, and then allocating data to the virtual lattice points; and storing the data at the respective virtual lattice points and the correction data at the lattice points except for the virtual lattice points in the virtual 3D lookup table in the first to eighth memories.

* * * * *